United States Patent [19]

Murdock

[11] 4,157,659

[45] Jun. 12, 1979

[54] OIL WELL INSTRUMENTATION SYSTEM

[75] Inventor: Douglas B. Murdock, Bellevue, Wash.

[73] Assignee: Resource Control Corporation, Redmond, Wash.

[21] Appl. No.: 882,020

[22] Filed: Feb. 27, 1978

[51] Int. Cl.[2] ..... E21B 47/06

[52] U.S. Cl. ..... 73/151; 73/714

[58] Field of Search ..... 73/151, 152, 714, 718; 340/18 FM, 18 LD, 18 R

[56] References Cited

U.S. PATENT DOCUMENTS

| | | | |
|---|---|---|---|
| 2,848,710 | 8/1958 | Owen | 73/151 X |
| 3,991,611 | 11/1976 | Marshall et al. | 340/18 FM X |

*Primary Examiner*—Jerry W. Myracle

*Attorney, Agent, or Firm*—Seed, Berry, Vernon & Baynham

[57] ABSTRACT

An oil well instrumentation system for measuring the pressure and temperature at various depths during drill stem tests. The measurements may be hydrodynamically analyzed to map the geological structure of an oil field in order to select drilling locations. The measurements may also be utilized to calculate properties of an existing oil well such as total production and optimum production rate and to determine the geologic properties of the structure in which the well is drilled such as porosity. The system includes a pressure sensor, a temperature sensor and a microprocessor based device receiving the outputs of the pressure and temperature sensors for displaying and recording periodic measurements. The display and recording device is powered by a rechargeable battery, and the condition of the battery is internally monitored and an indication of its condition is displayed. Oil well measurements are relatively short in duration, but they are normally made over a relatively long period of time so that a substantial period of time elapses between measurements. In order to preserve the life of the battery between rechargings, the display and recording device is placed in a quiescent mode between measurements in which power is removed from most of the internal components including the microprocessor.

9 Claims, 10 Drawing Figures

OIL WELL INSTRUMENTATION SYSTEM

BACKGROUND OF THE INVENTION

1. Field of the Invention

This invention relates to oil well instrumentation systems, and more particularly, to a system for measuring, recording and displaying the pressure and temperature at various depths in an oil well drill stem.

2. Description of the Prior Art

Oil well drilling is extremely expensive and thus it is desirable to choose drilling locations which have a relatively good possibility of providing sufficient yields to justify the drilling costs. In order to select optimum drilling locations it is necessary to know the properties of the subsurface geological structure. These properties are determined by measuring pressure at various depths in a test hole to generate pressure versus depth plots. The plots are then hydrodynamically analyzed to determine the continuity or discontinuity, both laterally and vertically, of pressure systems within the geologic column. Pressure is normally measured during a stabilized shut-in pressure buildup. In this technique, the pressure and temperature sensors are lowered through the drill stem and a packer is placed above the transducer to seal the drill stem. Pressure below the packer then rises to a stabilized level and the measurements are taken. Measurements are then repeated at a different depth with the packers moved to seal off different geologic zones. After samples are recovered from the drill stem at various depths, the hydrocarbon recoveries can be related to their respective hydrodynamic systems in order to approximate the location of the gas/water or oil/water contact.

Various types of geographical representations of pressure data can then be generated. A potentiometric surface map shows the potential of a given horizon to support a column of free-standing water of known density at a given point expressed in feet of water. A potentiometric surface map generally defines areas of continuous permability and indicates the presence of possible barriers between these areas which may constitute stratigraphic traps. A barrier to fluid migration is indicated by a rapid change in potentiometric values.

Another type of geographic representation of pressure data is the pressure deflection map. This is a map of pressure values at various points with respect to a key hydrodynamic system. Barriers to fluid migration may be inferred by sudden changes in the pressure deflection values.

The contour interval selected for either the potentiometric surface map or the pressure deflection map is limited largely by the measurement error inherent in the pressure measuring device. With conventional pressure measuring devices it is not possible to measure pressures with sufficient accuracy to allow relatively small contour intervals. This limitation may reduce the reliability and usefulness of such geographical representations of pressure data.

Drill stem pressure tests are also performed in order to measure the properties of an oil well and the surrounding structure in order to calculate the total production of the well as well as the optimum production rate. According to this technique, a packer is utilized to seal a drill stem and the subsequent pressure increase below the packer is measured. The rate of pressure increase provides an indication of the porosity of the structure the oil is in as well as the production rate.

Also, flow from the well can be increased until pressure starts to drop thereby providing a good indication of the rate at which flow can be sustained.

In an interference test, pressurized water is injected into a first well and the pressure response in a different well is measured. In a pulse testing mode, the water is injected into a stimulus well at periodic intervals and the pressure is recorded in an observation well. Although pulse testing theory is well developed, the lack of an extremely sensitive pressure gauge has always limited practical applications because the effects of pressure at the observation well are usually small. The most important advantage of pulse testing is that transients observed as a result of the pulse stimulus are easily distinguished even in the presence of unrelated dynamic reservoir pressure behavior. The results of the pulse tests allow the calculation of in situ permability and formation thickness between wells.

The most common device currently used for oil well pressure tests are analog pressure transducers connected to conventional strip-chart recorders. These devices are not sufficiently accurate to be useful in many applications and it is difficult to accurately correlate the position of the markings on the strip-chart with time.

Another commonly used device is a self-contained pressure transducer and recorder which is lowered into the drill stem. The primary disadvantage of this device is that the pressure measurements cannot be read until the recording medium is processed at a distant location.

Although pressure is the most important measured property, temperature is also measured in order to normalize or calibrate the pressure measurements and to measure properties of fluids in the drill stem. For example, the pressure increase in the drill stem depends not only on the production rate of the well but also on the viscosity of the oil. In order to determine the true porosity of the structure surrounding the well and the oil well production rate, it is necessary to know the viscosity of the oil which can be inferred from knowing the temperature of the oil. Also, a knowledge of the characteristics of temperature variations can indicate the presence of a gas rather than a fluid.

SUMMARY OF THE INVENTION

It is an object of the invention to provide a system for measuring temperature and pressure with extreme accuracy.

It is another object of the invention to provide a system for measuring temperature and pressure in real time so that measurements are displayed outside the drill stem at the same time as they are being made.

Another object of the invention is to provide a battery powered system having an extremely low quiescent current to allow periodic temperature and pressure measurements over a relatively long period of time.

It is still another object of the invention to provide a battery powered system for measuring temperature and pressure having means for internally monitoring and displaying the condition of the battery.

These and other objects of the invention are accomplished by a microprocessor based device receiving the output of a commercially available, extremely accurate pressure transducer positioned in an oil well drill stem. If desired, the microprocessor based device may also receive the output of a conventional analog temperature transducer also positioned in the drill stem. The recording and display device is battery powered so that it may be used in the field. In order to conserve battery life during the relatively long period over which the measurements are made, circuitry is provided for removing power from most of the internal components of the device when measurements are not being made. This powering down function is accomplished by a conventional MOS alarm clock circuit having internal timing means for powering up the system when a measurement is to be made. The alarm clock circuit is programmed at the start of each quiescent period by the microprocessor. Circuits are also provided for synchronizing the random access memories as power is applied to and removed from the circuits in order to prevent the entry of spurious data during the power-up period.

DETAILED DESCRIPTION OF THE PREFERRED EMBODIMENTS

Figure 1:
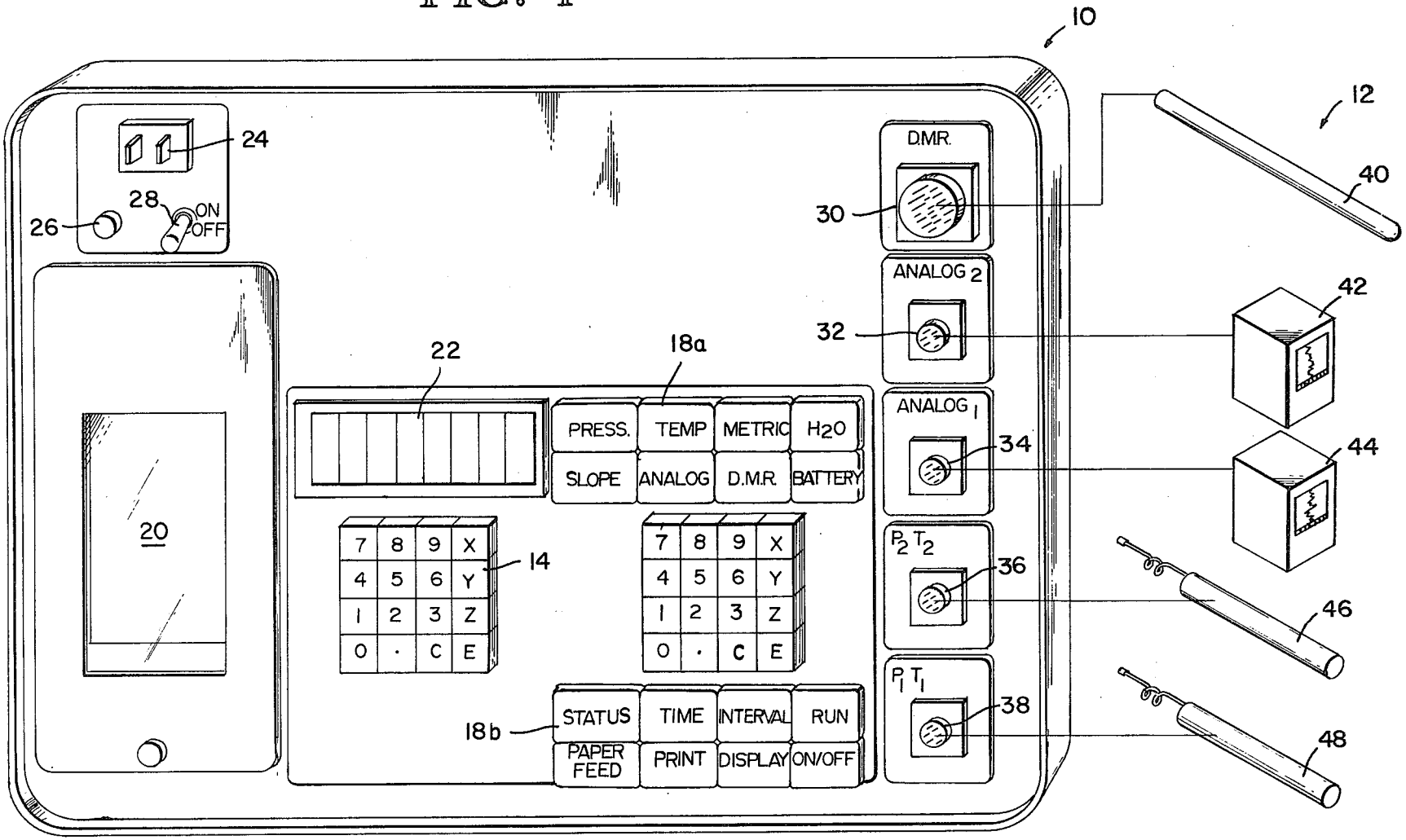
FIG. 1 is a top plan view of the microprocessor based device for recording and displaying the outputs of peripheral devices which are illustrated in isometric.

The oil well instrumentation system as utilized in the field is illustrated in FIG. 1. The system 10 receives inputs from and provides outputs to a variety of peripheral devices 12 as explained hereinafter. The front panel of the system 10 includes a numeric key pad 14 for entering data into the system and a function selection key pad 16 for controlling the operation of the system 10. The specific control function corresponding to each key of the key pad 16 is designated by the markings 18*a*, *b* positioned above and below the key pad 16, respectively. The system 10 includes two output devices, namely, a conventional printer 20 and an optical display 22. An AC power input 24 is located at the upper left-hand corner of the panel along with a fuse receptacle 26 placed in series with the AC power input 24 and a master power switch 28 for applying battery power to the internal circuitry as explained hereinafter.

The peripheral devices 12 are connected to the system through connectors 30–38. Briefly, the digital memory recorder connector 30 receives data from a direct memory recorder 40 which has been placed in the memory recorder 40 over a relatively long period of time, often while the recorder 40 is placed in an oil well drill stem. The analog outputs 32, 34 drive conventional Rustrak analog recorders 42, 44, respectively. The recorders 42, 44 are conventional strip chart recorders, and the end limit and scale factors for the recorders 42, 44 are manually selected on the key pad. The transducer input connectors 36, 38 each receive the output of a pressure and temperature transducers 46, 48, respectively. The pressure sensing portions of transducers 46, 48 are specially adapted for insertion in the drill stem and are manufactured by Paroscientific, Inc. of Redmond, Wash. These transducers include a diaphragm which transmits a force proportional to the pressure on the diaphram to a force transducer described in U.S. Pat. Nos. 3,470,400 and 3,479,536. Briefly, these force transducers include a crystal oscillator operating at a frequency which is related to the force imparted to the crystal by the pressure sensing diaphragm by the following equation:

$$P=A(1-T_0/T)-B(1-T_0/T)^2$$

where P equals pressure, A, B and $T_0$ are calibration coefficients which characterize the transducer, and T is the period of the signal at the output of the transducer.

The calibration coefficients A, B, $T_0$ depend upon the physical parameters of each individual transducer with which the system is used, and thus vary from one transducer to another. It will be noted that the physical variable, namely pressure, measured by the transducer is non-linear so that the value of the physical variable is not directly proportional to a time related characteristic of the output signal, such as the signal's period of frequency. The temperature sensing portions of transducers 46, 48 are available from Analog Devices of Norwood, Mass.

Figure 2:
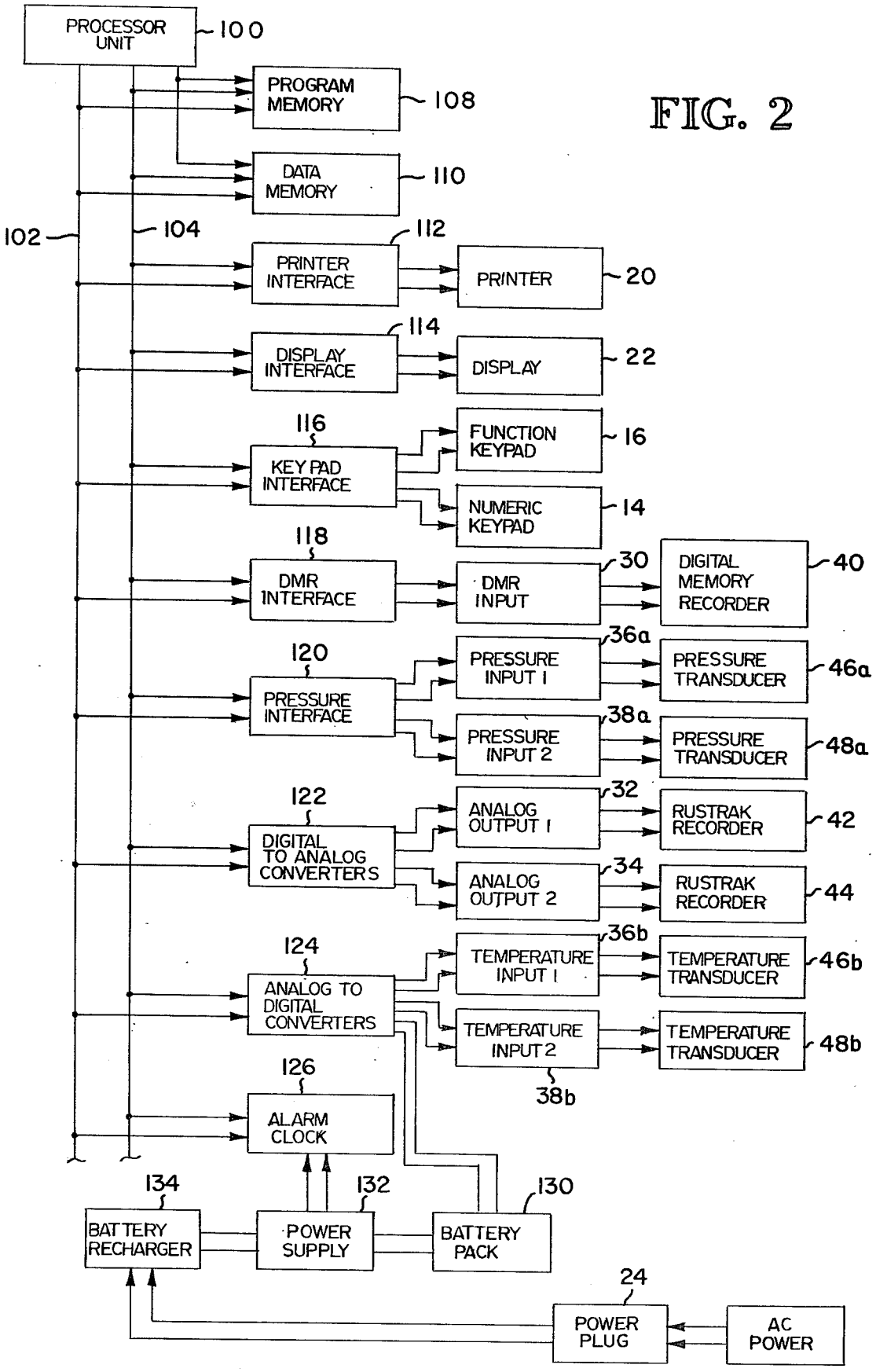
FIG. 2 is a schematic of the block diagram of the oil well instrumentation system.

A block diagram of the system 10 is illustrated in FIG. 2. The apparation of the entire system is illustrated in FIG. 2. The operation of the entire system is controlled by a processor unit 100 which is tied to the various other subsystems through a data bus 102, a control bus 104 and an address bus 106. The data bus 102 is a bi-directional conduit composed of several signal lines on which data can flow between the processor unit 100 and the other systems such as a program memory 108, a data memory 110 and interface circuits 112, 114, 116 for the printer 20, display 22 and key pads 14, 16, respectively. The data bus 102 is also connected to interface and conversion circuits 118, 120, 122, 124 which are connected to the peripheral devices 40, 46*a* and 48*a*, 42 and 44, 46*b* and 48*b*, respectively. The data bus 102 is also connected to an alarm clock 126 which, as explained hereinafter, powers down the system when measurements are not being made in order to preserve battery life.

The address bus 106 is a uni-directional group of signal lines on which signals originating at the processor unit 100 identify a particular memory location in the program memory 108 or data memory 110.

The control bus 104 is a uni-directional set of lines in which signals originating at the processor unit 100 control the operation of the various subsystems such as the 108, 110 printer 20, display 22, key pads 14, 16, DMR 40 and pressure interface 120, the D-to-A and A-to-D converters 122, 124, respectively, and the alarm clock 126. The number of signal lines in a given bus is determined by the number of bits which characterize the various devices used in the system.

The processor unit 100 operates in accordance with the plurality of instructions which are stored in the program memory 108 which may be a read only memory (ROM). The processor unit 100 contains an instruction counter which is incremented to sequentially execute the various instructions stored in the program memory 108. The program memory 108 makes available at the data bus 102 the instructions stored at the memory location designated by the address bus 104 when the program memory 108 is selected by the control bus 106. The instruction memory is non-volatile so that the data contained therein is not affected by the loss of power to the system.

The data memory 110 is provided for storing the calibration coefficients A, B, $T_0$ entered into the system by the key pad 114, and for storing data received from the processor unit 100. The data memory 110 stores data presented on the data bus in a memory location designated by the memory address on the address bus responsive to appropriate signals on the control bus 106, and it makes available to the data bus 102 data stored in memory locations selected on the address bus 104 responsive to appropriate signals on the control bus 104. The data memory 110 unlike the program memory 108, is a volatile memory and thus the data stored therein is erased when power is removed from the memory 110.

The entire system is powered from a battery pack 130 which is driven by a power supply 132 for recharging the battery pack 130 from a charger 134 on receipt of AC power through the power plug 24.

Figure 3:
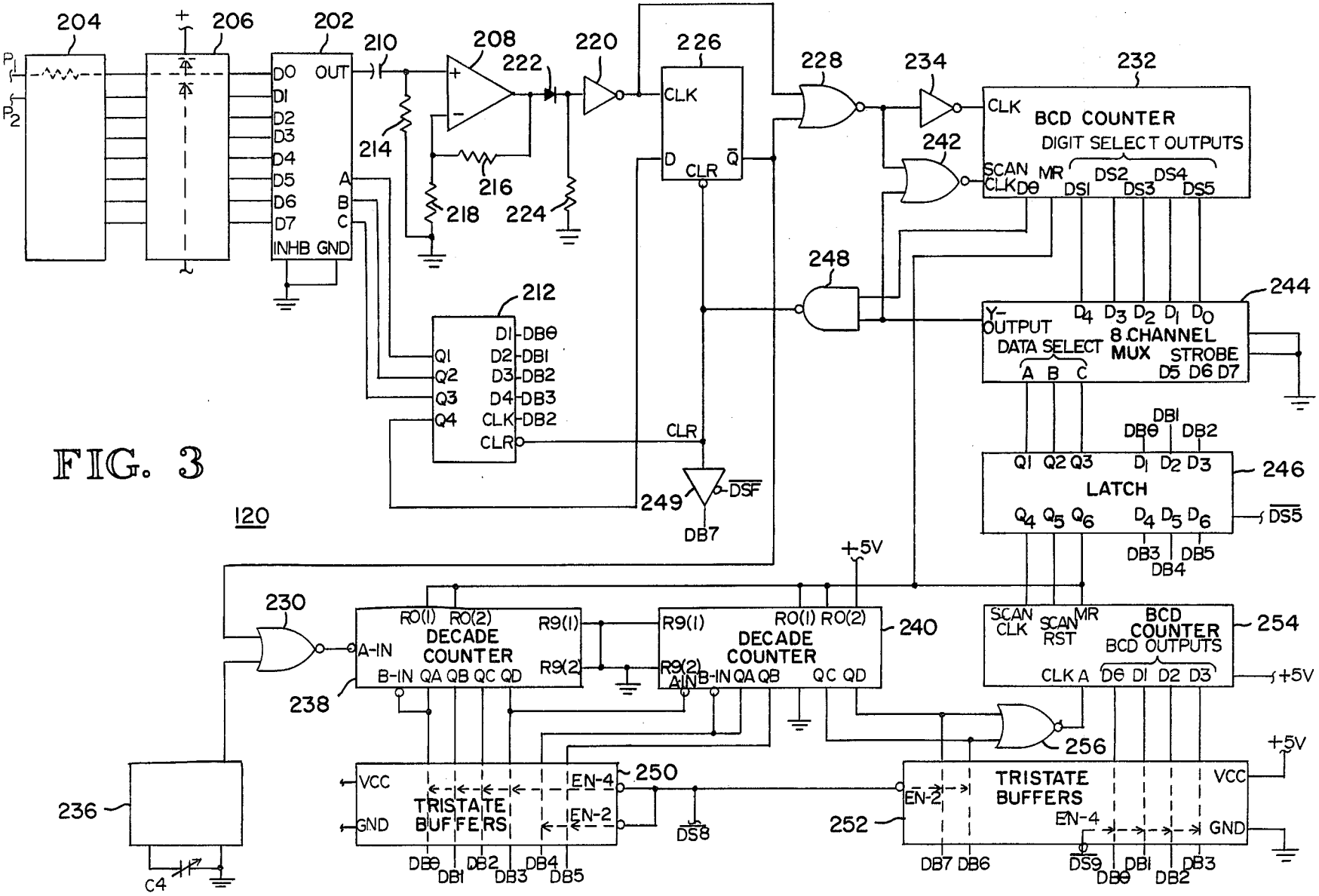
FIG. 3 is a schematic of the interval counter for determining the frequency of the signal from the output of the pressure transducers.

The pressure interface 120 is illustrated in FIG. 3. The output of the pressure transducers 46*a*, 48*a* are applied to an analog multiplex unit 202 through current limiting resistors 204. The signals at the inputs to the multiplex unit 202 are connected to plus and minus supply voltages through diodes in a diode array 206 in order to prevent the inputs to the multiplex unit 202 from exceeding the supply voltages. The output of the multiplex unit 202 is AC coupled to the input of an operational amplifier 208 through a capacitor 210. The particular pressure input, P1 or P2, connected to the amplifier 208 by the multiplex unit 202 is determined by the BCD outputs $Q_1 \ldots Q_3$ of a latch 212. Thus the pressure transducer 46*a*, 48*a* applied to the amplifier 208 is selected by latching the data on the data bus lines DB0 . . . DB2 to the output of the latch 212 when the $\overline{\text{DS4}}$ line from the control bus goes low. The latch 212 is cleared in order to select another transducer by a negative going signal on the CLR input.

The resistors 214, 216, 218 associated with the amplifier 208 provide hysteresis for the comparator 208 in order to prevent noise generated output signals. The amplifier 208 then drives an inverter 220 through a diode 222. The cathode of diode 222 is connected to ground through resistor 224. The diode 222 and resistor 224 are provided to transform the output of the amplifier 208 into appropriate logic levels for the inverter 220. Thus the output of the inverter 335 is a square wave having a frequency equal to the frequency of the pressure transducer output selected by the processor unit 100 through the data bus 102. The frequency of the square wave at the output of the inverter 220 is, of course, a known function of the pressure sensed by the selected pressure transducer 46 or 48*a*.

The output of the inverter 220 is received by an interval counter. The basic concept of the interval counter is to allow a first counter to count cycles at the output of the inverter 220 until a count equal to a predetermined power of 10 is reached. A second counter incremented at a known frequency then indicates the interval over which the given number of cycles at the output of inverter 220 were counted allowing the average period of the selected pressure transducer output to be computed. For example, for a pressure transducer output of 40 kHz, the first counter counts to 10,000 in 250 milliseconds. During this interval the second counter is incremented in a fixed, considerably faster rate, for example 10 mHz, so that in the 250 millisecond interval that the first counter counts to 10,000 the second counter counts to 2.5 million. Thus, for each cycle of the transducer output there are 250 cycles of the oscillator driving the second counter. The final count of the count interval as determined by the first counter may occur at any time during a counting cycle of the second counter, i.e., the 10,000 count of the first counter (the final count of the count interval) may occur on the 2,499,999.54 count of the second counter. Since the second counter increments in units the final count or fraction thereof for the second counter will generally be dropped. This "round-off error" is a lower percentage error for larger final counts of the second counter, i.e., a count of 99.9 recorded as 99 is about a 0.9% error while the same 0.9 count error for a larger count, 999,000.9, recorded as 999,000 is only about a 0.00009% error. Thus the accuracy of the average period measurement is determined by the magnitude of the final count of the second counter. This is in turn determined by the length of the counting interval, (i.e. whether the first counter counts up to 10,000 or some higher or lower number) and the ratio between the operating frequency of the second counter and the operating frequency of the first counter. For a final count of the second counter of 2,500,000 the error is about $4\times10^{-5}\%$, or 1 part in $2.5\times10^{6}$. The average period over the interval of 10,000 cycles of the transducer output can be calculated simply by dividing the count in the second counter by the count in the first counter and multiplying by the period of the oscillator signal driving the second counter. For example, the 2.5 million count of the second counter divided by the 10,000 count of the first counter times the $10^{-7}$ period of the 10 mHz oscillator is equal to a 25 microsecond average period of the transducer output which corresponds to 40 kHz. It is important to note that since the interval during which the measurement is made is equal to a predetermined power of 10 cycles of the transducer output, the count of the second counter can be divided by the count of the first counter simply by shifting the decimal point of the count in the second counter. The counting cycle begins at the first leading edge of the square wave at the output of inverter 220 after a "1" is latched to the Q4 output of latch 212. At this time the $\overline{Q}$ output of flip-flop 226 goes low enabling NOR gates 228 and 230. As NOR gate 228 is enabled the pressure transducer signal at the output of inverter 220 is gated to BCD counter 232 through inverter 234. As NOR gate 230 is enabled the output of oscillator 236 is gated to the input of decade counters 238, 240 which are connected in series. As soon as the output of flip-flop 226 goes low decade counters 238, 240 begin incrementing. However, the logic "1" at the output of inverter 220 maintains a logic "0" at the output of NOR gate 228 which maintains the CLK input to the BCD counter 232 at logic "1". After the next half cycle of the transducer signal, the CLK input goes low, but since the BCD counter 232 is leading edge triggered the counter 232 does not increment until the beginning of the next cycle of the transducer signal. At this time the output of inverter 220 goes high thereby producing a "0" to "1" at the output of inverter 234 which increments the counter 232. Thereafter the counter 232 increments once for each cycle of the transducer output signal. Thus the decade counters 238, 240 are incremented during one entire cycle of the transducer output before the decade counter 232 begins incrementing. The reason for this operation is to insure that at each point in time when the counter 232 is incremented the decade counters 238, 240 will have been incremented to a number equal to the product of the count of the first counter and the ratio of the period of the transducer output over the period of the signal from the oscillator 236. This procedure insures that when the counter 232 reaches a predetermined power of 10 the count of the decade counters 238, 240 divided by that number is proportional to the average period of the transducer output signal. If all of the counters 232, 238, 240 began incrementing together this would not be the case. For example, using the frequency examples given above, if both counters 232, 238 began incrementing simultaneously, the count in the counter 232 would be 1 at the same time the count in the decade counters 238, 240 was 1. When the count in the counter 232 reached 2 the count in the decade counters 238, 240 would be 250. When the count in the counter 232 reached 3, the count in the decade counters 238, 240 would be 500. Note that dividing the count in the decade counters 238, 240 by the count in the counter 232 for each of these examples yields a different erroneous average period calculation. However, where the decade counters 238, 240 are permitted to increment for an entire cycle of the transducer output signal before the counter 232 is incremented, this erroneous result does not occur.

The 5 decade BCD counter 232 may be a MC 14534 real time 5-decade counter available from Motorola. The counter 232 is composed of 5-decade ripple counters having their respective outputs time multiplex using an internal scanner. Outputs for one counter at a time are selected by the scanner and appear on 4-BCD outputs D0, D1, D2, D3 only one of which, D0, is used in the instant application. The selected counter or decade is indicated by a "1" on the corresponding digit select output DS1, DS2, DS3, DS4, DS5. The counters and scanner may be independently reset by applying a logic "1" to the counter master reset input MR. The counter 232 initially presents the BCD value of the 5th decade at its output. Thus, when the counter 232 reaches 10,000, the D0 output rises to "1". As the scanner clock input SCAN CLK is incremented, the counter 232 outputs the sequentially lower decades. At the same time, a logic "1" appears at the display scanner outputs DS5, DS4, DS3, DS2, DS1 in sequence to indicate which decade of the 5-decade BCD counter 232 is being outputed. Thus when the 5th decade of the counter 232 is being outputed, the DS5 line is "1". A leading edge of a signal at the SCAN CLK input then outputs the 4th decade of the counter 232 in BCD form, and a "1" appears at the DS4 output. The SCAN CLK input to counter 232 is initially triggered by the first transducer output signal at the output of NOR gate 228 through NOR gate 242 assuming, for the moment, that the other input to NOR gate 242 is "0". Thus during the initial counts of the counter 232, the display scanner lines DS5, DS4 . . . DS1 are sequentially decremented. The display scanner outputs DS5, DS4 . . . DS1 are connected to an 8 channel multiplexer 244 which connects one of the scanner lines DS5, DS4 . . . DS1 to the Y OUTPUT and hence the other input to NOR gate 242. The particular scanner line DS5, DS4 . . . DS1 selected by the multiplexer 244 to apply to the Y OUTPUT is determined by a three bit data select word from the outputs Q1 . . . Q3 of a latch 246. Data on the data bus lines DB0 . . . DB2 are latched to the outputs Q1 . . . Q3 of the latch 246 when the DS5 input to the latch 246 from the control bus goes low. When the chosen digit select output DS5 . . . DS1 goes high, NOR gate 242 is disabled so that the scanner can no longer be clocked thereby causing the decade selected by the multiplexer 244 to be continuously present at the output D0. The "1" at the Y OUTPUT of the multiplexer 244 also enables NAND gate 248 so that when the least significant bit of the selected digit is reached, the "1" at the D0 output produces a "0" at the output of NAND gate 248 which clears flip-flop 226 and latch 212 and informs the processor unit 100 that the counting interval is over through driver 249. During the counting interval the "1" at the output of the driver 249 informs the processor unit 100 that a count is being made.

By selecting the appropriate digit select output DS1, DS2 . . . DS5, the multiplexer 244 can select a counting interval which is between 1 and 10,000 cycles of the pressure transducer output. A large sample time, in which a large number of cycles are sampled, produces more accurate results, but requires a relatively long period of time to complete the measurement. For example, a count interval of 10 is accomplished in about 250 microseconds while a count interval of 10,000 cycles requires 250 milliseconds. However, a count interval of 10 cycles only allows the counters 238, 240 to count to 2,500 compared to a 2,500,000 count for a 10,000 cycle count interval. Consequently, the percentage of error from rounding off the final count is 3 orders of magnitude greater than for the 10 cycle counting interval. The counting interval is selected by an instruction in the program itself and transmitted to the multiplexer 244 through the data bus and the latch 246.

After the end of the counting interval, the outputs of the decade counters 238, 240 are applied to tri-state buffers 250, 252 which are continuously accessible to the data bus when the $\overline{DS8}$ line is actuated. The two most significant bits of the counter 240 increment a five decade BCD counter 254 through a NOR gate 256. Five decade BCD counter 254 is indentical to the BCD counter 232 except that different input and output functions are utilized. The count in the BCD counter 254 is sequentially applied to the tri-state buffers 252 by first actuating the SCAN RST line to apply the fifth decade in the counter 254 to the buffer 252. The SCAN CLK input is periodically actuated by the processor through the data bus and latch 246 to sequentially apply the fourth, third, second and first digit of the BCD counter 254 to the tri-state buffers 252. The processor unit 100 (FIG. 2) receives the interval count from the tri-state buffers 250, 252, and computes the length of the interval by moving the decimal point of the count from the counters 238, 240, 254 a number of digits depending upon the data select output DS1, DS2 . . . DS5 selected by the multiplexer 244. The processor unit 100 then utilizes the value of the interval to compute the pressure sensed by the pressure transducer. Another counting cycle then begins after a MR signal from the latch 246 resets the counters 238, 240, 254, 232 and the appropriate data bus code has been clocked through the latch 212 by a "0" on the $\overline{DS4}$ line.

The processor unit 100, as illustrated in FIG. 1*a*, includes a central processing unit 300 which may be an 8080A Central Processing Unit available from the Intel Corporation of Santa Clara, Calif. The central processing unit 300 is a dynamic device, i.e. its internal storage elements and logic circuitry require a timing reference supplied by external circuitry to provide timing control signals. The Intel 8080 Central Processing Unit 300 requires two equal frequency phased offset clock signals $\phi$1 and $\phi$2 which are supplied by a clock 302 which may be an Intel model 8224 clock generator driver. The interfacing between the clock 302 and the central processing unit 300 includes the two clock signals $\phi$1 and $\phi$2, and a ready signal which causes the central processing unit 300 to suspend operation until external memory has been accessed. The clock 302 and central processing unit 300 also include RESET inputs which initialize the program counter to the first program instruction in response to $\overline{\text{RESIN}}$ becoming "0". This reset occurs when power is initially applied to the system since capacitor 304, being initially discharged, holds the $\overline{\text{RESIN}}$ input to the clock 300 low when power is applied until the capacitor 304 is sufficiently charged through resistor 306. A diode 308 quickly discharges the capacitor 304 when power is removed from the system.

Data and control signals from the central processing unit 300 are routed through a bi-directional bus driver 310 which may be an Intel 8238 model. The bus driver 310 gates data on and off the data bus within the proper timing sequences as dictated by the operation of the central processing unit 300. The bus driver 310 also determines what type of device (e.g. memory or I/O) has access to the data bus by generating appropriate control signals. Data is loaded into the bus driver 310 from the central processing unit by a $\overline{\text{STSTB}}$ which occurs at the start of each machine cycle. The central processing unit 300 receives data through the bus driver 310 from a plurality of random access memories 312–322 at a memory location determined by the address generated on the address bus by the central processing unit 300. The random access memories 312–322 are volatile so that data stored therein is lost when power is removed. Thus some of the random access memories 312–320 are separately powered by voltage regulator 323 through diode 325. Since each of the random access memories 312–322 store only four-bit words, the random access memories are addressed in parallel so that one of the random access memories supplies the first four-bits of an eight-bit word and the other random access memories supply the remaining four-bits. Data is read into the memory when the $\overline{\text{MEMW}}$ at the output of the bus driver 310 goes low and the appropriate chip select line $\overline{\text{CS}}$ and RAM-EN enables the random access memory. Thus, when the $\overline{\text{MEMR}}$ and $\overline{\text{CS8}}$ go low, data is read into random access memories 312, 318 at the address designated by the address bus AB0, AB1 . . . AB7. Similarly, data is read from the random access memories 312–322 when a particular address at a particular set of memories are addressed and the $\overline{\text{MEMR}}$ line at the output of the bus driver 310 goes low. The chip select signals CS0, CS1 . . . CS7 and CS8, CS9 are generated from the higher order address bits at decoders 324, 326, respectively. The control signals for the random access memories 316, 322 are generated from either the $\overline{\text{MEMW}}$ or $\overline{\text{MEMR}}$ signals by NAND gate 328. Similarly, device select signals $\overline{\text{DS0}}$, $\overline{\text{DS1}}$ . . . $\overline{\text{DSF}}$ are generated by decoders 330, 332 from the address bus and from either an $\overline{\text{I/OR}}$ or $\overline{\text{I/OW}}$ from the bus driver 310 through NAND gate 334. The instructions for controlling the operation of the central processing unit 300 are stored in read only memories 340–350.

The instructions stored at a specified address location are presented to the data bus when the appropriate chip select signal $\overline{\text{CS0}}$, $\overline{\text{CS1}}$ . . . $\overline{\text{CS5}}$ is produced and the central processing unit 300 generates the appropriate address. The data outputs of the read only memories are either floating or ground so that a set of pull-up resistors 352 are provided to raise the voltage level to an appropriate voltage in a logic "1" condition.

The key pads 14, 16, each of which include a plurality of push-to-close switches, are wired in parallel so that the inputs to a 16-BCD decoder 370 go high whenever the corresponding switch for either key pad 14, 16 is actuated. The outputs of the decoder 370 are connected to the data bus through a bus driver 372 whenever the $\overline{\text{DS1}}$ line goes low. When any of the switches in keypad 14 are actuated transistor 371 is saturated through diode 373. Transistor 371 is normally held at cutoff by resistor 375 so that the collector of transistor 371 is held low through resistor 377. Thus when a switch in keypad 14 is actuated a positive going pulse is sent to bus driver 372 (FIG. 4B) to inform the processor unit that it is the keypad 14 that is being addressed. Circuit 379 operates in a similar manner to inform the processor unit that keypad 16 is being addressed. In this manner two keypads 14, 16 are multiplexed through a common decoder 370.

Figure 4A:
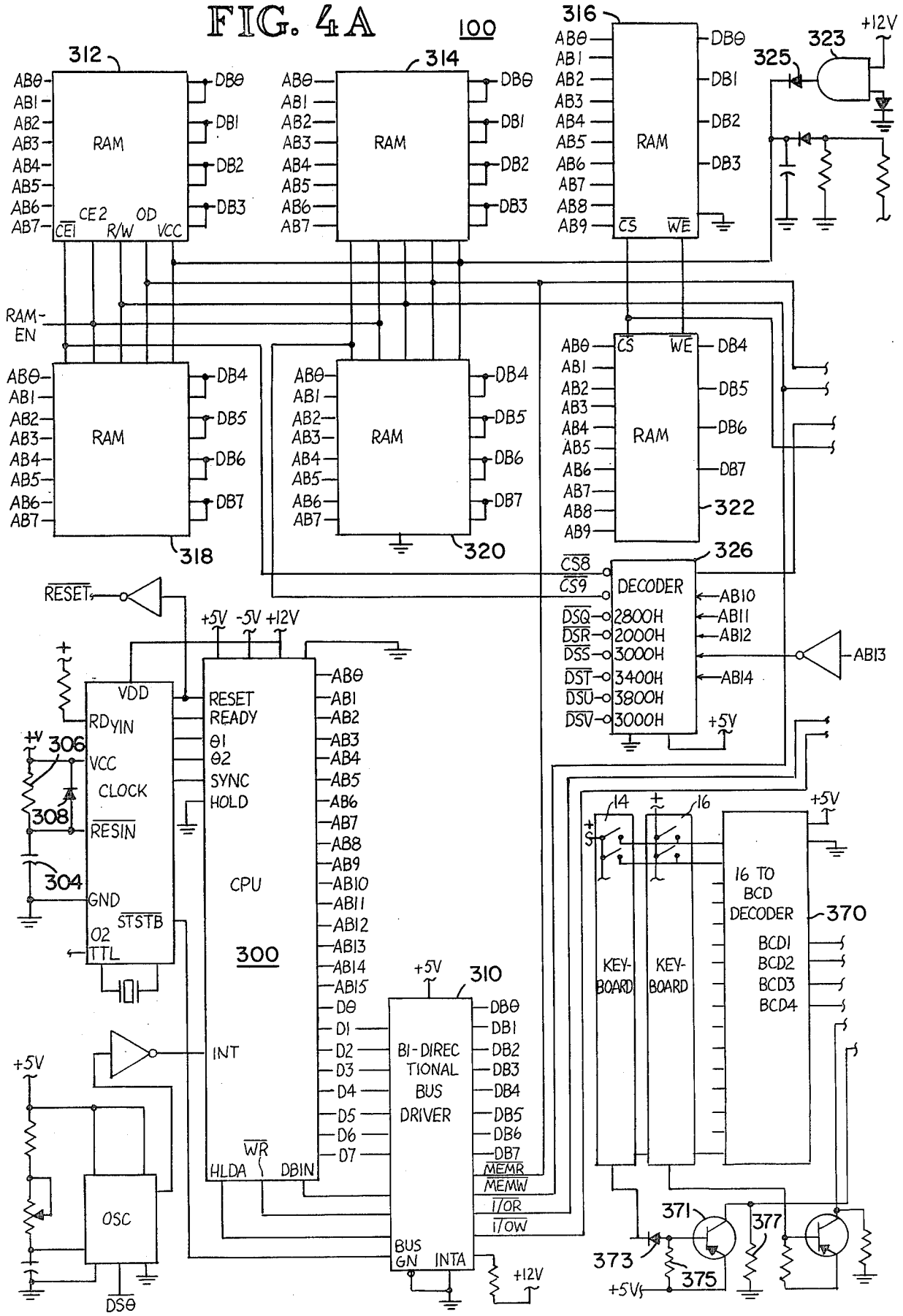
FIG. 4*a* is a schematic of the processor unit, random access memories and keyboard of the device.
Figure 4B:
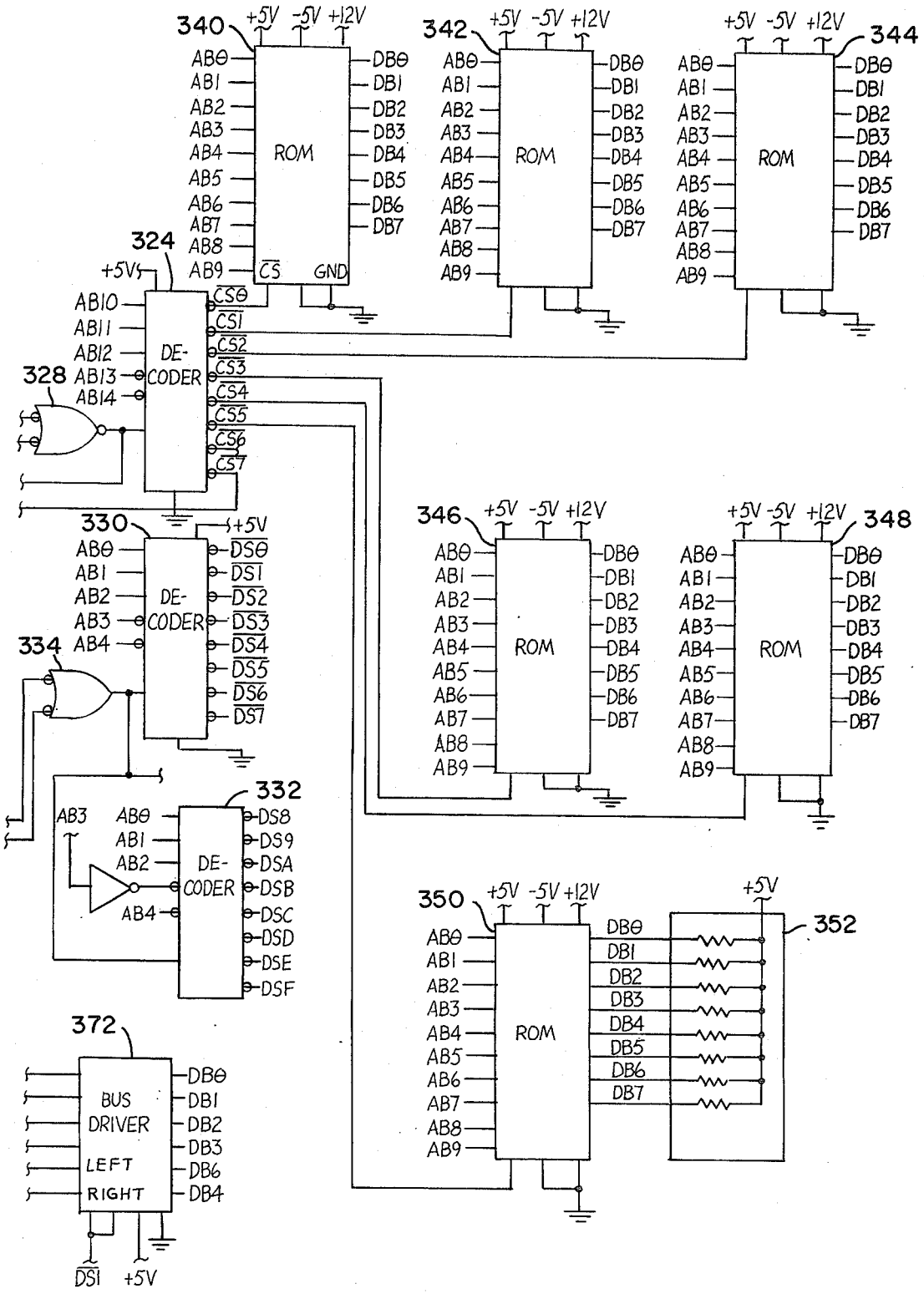
FIG. 4*b* is a schematic of the read only memory and address decoder circuitry.
Figure 4C:
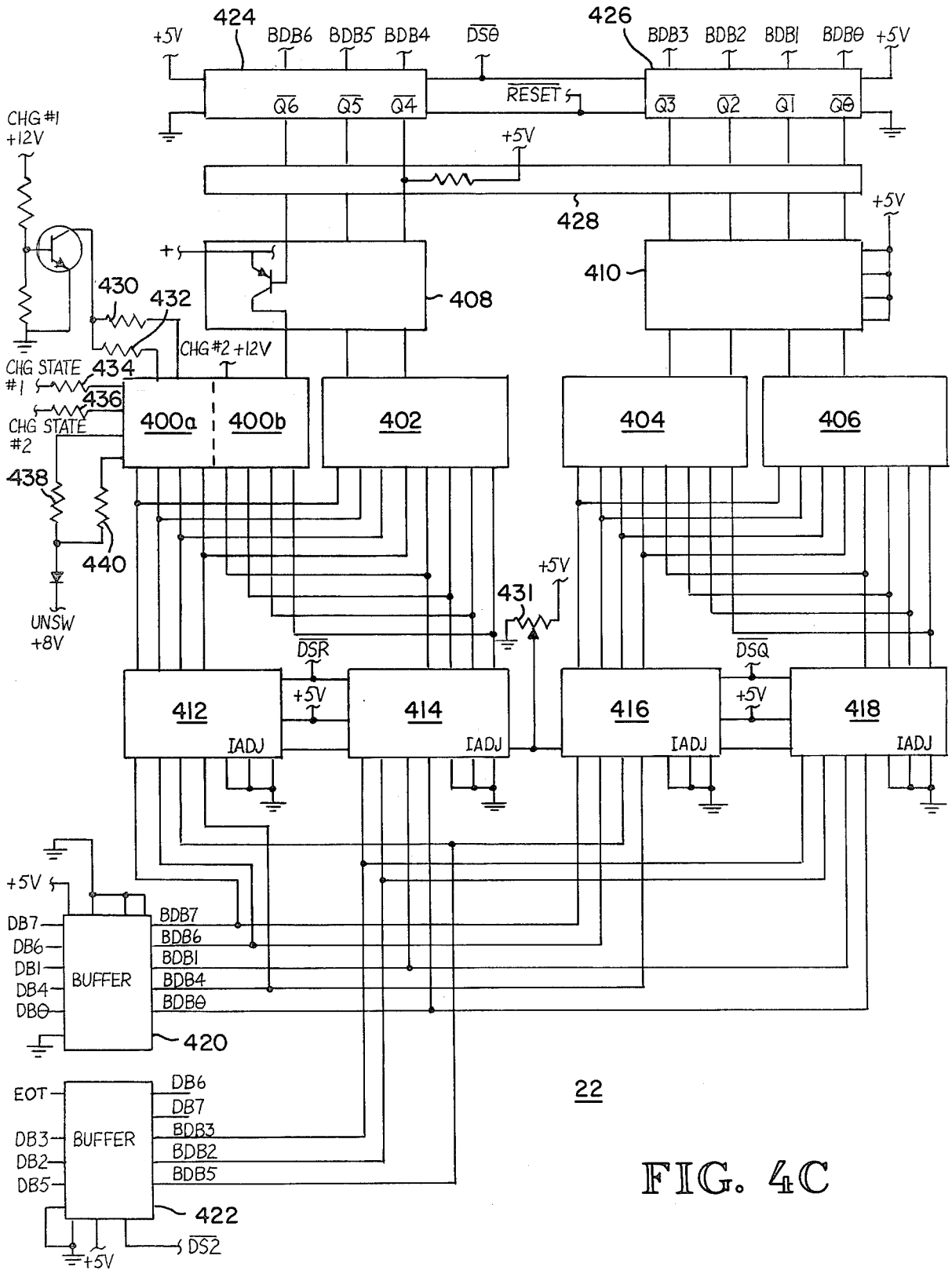
FIG. 4*c* is a schematic of the circuitry for displaying pressure measurements, temperature measurements and battery condition.

The display 22, as illustrated in 4*c*, includes four LED modules 400–406 which may be series MAN 6600 displays available from Monsanto. Each of the modules 400–406 includes two light emitting diode arrays 400*a,b*–406*a,b*. Each of the arrays 400*a,b*–406*a,b* are sequentially illuminated by sequentially switching on each of the transistors in transistor modules 408, 410 thereby sequentially illuminating each digit 400*a*–400*b*. The particular number displayed by each of the digits 400*a*–406 are determined by which of the lines from the display modules 400–406 are actuated by respective display driver latches 412–418. Display driver latches 412–418 may be model DS 8859J display drivers available from National Semi-Conductor which consist of a number of drive flip-flops clocked by a common strobe input. Note that the light emitting diode modules 400–406 are driven in pairs so that only one pair of modules may be actuated at a given time. The central processor 100 executes a display subroutine in which data from the data bus are stored in latches 420, 422. The outputs of the buffers 420, 422 actuate the driver latches 412–418 to allow current to flow through selected output lines of the display modules 400–406 whenever a $\overline{\text{DSR}}$ or $\overline{\text{DSQ}}$ signal is received from the decoder 326 (FIG. 4*a*). The particular digit of the display modules 400–406 which will be illuminated is determined by the transistor modules 408, 410 which are in turn controlled by latches 424, 426. Pullup resistor module 428 is provided to raise the output voltage from the latches 424, 426 to an appropriate drive level in a logic "1" condition. In operation, the first digit of the display module 400*b* is enabled by transmitting a "1" on data bus DB6 to the buffer 420. Thereafter the $\overline{\text{DSO}}$ line goes low storing the "1" in the latch 424 and forward biasing the transistor in transistor module 408. At this point the digit 400*b* is enabled. During the next processor cycle, appropriate signals are transmitted over the data bus to the buffers 420 & 422 for producing outputs for driving the individual segments of the light emitting diode arrays which, when the $\overline{DSR}$ signal is received by the driver latches 412 & 414 causes a preset combination of light emitting diodes in the array 400*b* to become illuminated. Thereafter, the remaining display modules 402*a*–406*b* are sequentially illuminated in the same manner. A variable resistor 431 is provided for adjusting the voltage to the IADJ inputs to the driver latches 412–418 for controlling the amount of current flowing through the light emitting diodes and hence the intensity of the display.

The leftmost digit of the display module 400*a* is utilized to indicate the condition and charging rate of the internal batteries powering the system. For this purpose appropriate currents are caused to flow through resistors 430–440 as explained hereafter. Briefly, the upper and lower sections of the display 400*a* correspond, respectively, to first and second batteries and associated chargers. The left and center segments of the digits are illuminated when the corresponding batteries are being charged but are not up to fully potential. The right most segments of the digits are illuminated when both of the batteries are fully charged. Thus, for example, a blank upper portion of the display indicates that one of the chargers is not functioning properly while segments illuminated to form the letter C indicate that both chargers are working properly but the batteries are not fully charged. When the segments are illuminated to form the letter O the display indicates that both batteries are fully charged.

Figure 5:
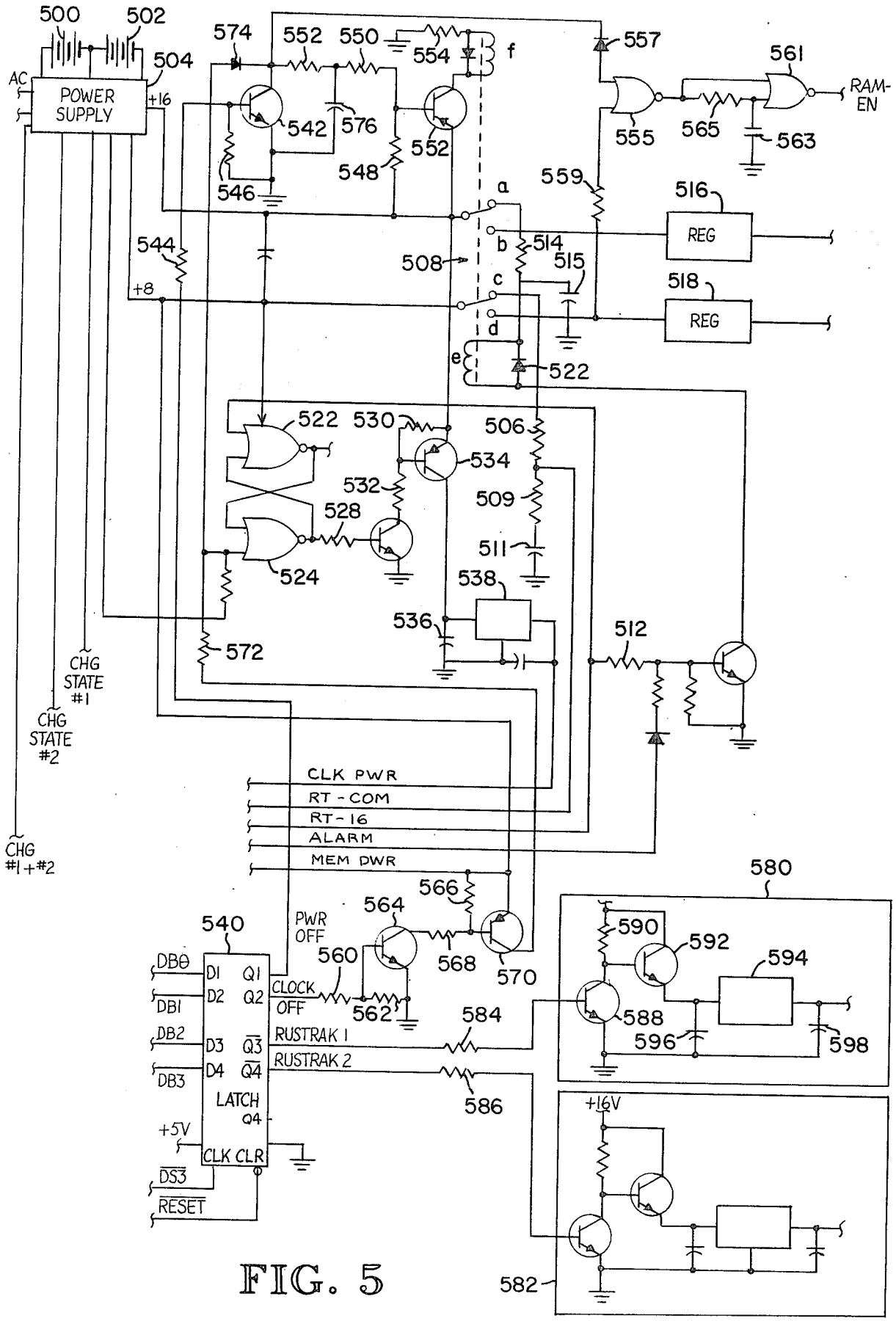
FIG. 5 is a schematic of the circuits for supplying power to the device.

The power supply circuitry illustrated in FIG. 5 charges a pair of internal batteries 500, 502, regulates the battery or power supply voltage to provide a large number of specified voltages and selectively removes power from the major portion of the system during a "sleep" mode as described hereinafter.

AC power is applied to a conventional power supply 504 which includes a battery charger for charging the batteries 500, 502. The power supply 504 also includes conventional voltage sensing circuits for providing signals CHG STATE #1 and CHG STATE #2 indicative of the charge of the batteries 500, 502, respectively.

The positive 8 and 16 volt outputs of the power supply 504 are applied to a switching circuit for applying power to the system and removing the power during the "sleep" mode. The basic concept of the "sleep" mode is to remove power from virtually the entire system during a period when measurements are not being made. As the system is used, measurements may be made for a brief period of time spaced apart by a considerably longer period of time. Consequently, since the system is often battery powered, it is important to reduce battery drain in order to conserve battery life. Thus a timer is utilized to remove power from the entire system except for the timer itself and the volatile memories during the period where measurements are not being made.

Power is initially applied to the system by actuating the on/off switch on the keyboard 16 thereby connecting the RT-COM line to the RT-16 through switch 16*a*. The 8 volt output from the capacitor 511, which charged in the "OFF state through resistors 506 & 509, is then applied to the RT-16 line through resistor 509. Resistor 509 and capacitor 511 provide a short duration pulse on the RT-16 line which saturates transistor 510 through resistor 512 allowing current to flow from capacitor 514 through the relay coil 508*e*. The relay 508 then switches the 16 and 8 volt outputs from the power supply 504 to voltage regulators 516, 518, respectively, which apply power to the entire system. The transistor 510 is normally held at cutoff by a resistor 520 extending between its base and emitter. Diode 522 is connected across the relay coil 508*e* to short circuit transients generated by the coil 508*e* to prevent damage to other components.

When the on/off switch of keyboard 16 is initially actuated, the 8 volt signal is also applied to a NOR gate 524 which is connected with NOR gate 524 to form a flip-flop. The logic "1" at the output of the NOR gate 524 then saturates transistor 526 through resistor 528 causing current to flow through resistors 530, 532 and saturating transistor 534. The 16 volt output of the power supply 504, which is filtered by capacitor 536, is then applied to a voltage regulator 538.

The output CLK PWR of the voltage regulator 538 is the power applied to the volatile memories and the timer during the sleep mode. When the system transitions to a sleep mode a logic "1" is transmitted to a latch 540 through the data bus bit DB0 when the $\overline{DS3}$ goes low. The output of the latch 540 is applied to the base of a transistor 542 through resistor 544. Transistor 542, which is normally held at cutoff by a resistor 546 extending between the base and emitter of the transistor 542 is then saturated causing current to flow from the 16 volt output of the power supply 504 through resistors 548, 550, 552 and the collector to emitter of the transistor 542. The current through resistor 548 forward biases the base emitter junction of a transistor 552 allowing current to flow through relay coil 508*f* and resistor 554. The contacts of the relay 508 are then actuated to remove power from the regulators 516, 518. Thus, during the sleep period, power is removed from virtually the entire system including the microprocessor and display circuitry. It is important to note, however, that power from the voltage regulator 538 continues to be applied to the volatile memories and the internal timer through the CLK PWR output. At the conclusion of the sleep period a signal on the ALARM input is applied to transistor 510 through diode 556 and resistor 558 to saturate transistor 510 allowing current to flow through relay coil 508*e* and switch the contacts of the relay 508 to apply power to the regulators 516, 518. It is important to note that the ALARM signal does not originate at any microprocessor controlled device since during the sleep period the microprocessor is not powered and thus is not available for control purposes.

The power supply also includes circuitry for preventing spurious data from being read into the random access memories during the transient period as power is being applied to the system during a sleep period. The inputs to NOR gate 555 are connected to the collector of transistor 542 and the input of regulator 518 through diode 557 and resistor 559. Consequently, during a sleep period the output of NOR gate 555 is "1" so that RAM-EN at the output of NOR gate 561 is "0". The "0" RAM-EN disables the random access memories as illustrated in FIG. 4*a*. At the end of the sleep period the output of NOR gate 555 goes low, but the output of NOR gate 561 does not go high until capacitor 563 has discharged through resistor 565. Thus the random access memories are not enabled until the other circuits in the system have stabilized.

Power is removed from the system by actuating the on/off switch of keyboard 16 which is sensed by the processor unit 100. The processor unit 100 then generates a logic "1" on the first two bits of the data bus which is latched to the Q1 and Q2 outputs of the latch 540. The CLOCK OFF output causes current to flow through resistors 560, 562 thereby saturating transistor 564 which causes current to flow through resistors 566, 568 from the memory power line MEM PWR thereby saturating transistor 570. As transistor 570 is saturated, the 8 volt output from the power supply 504 is applied to NOR gate 524 through resistor 572 causing the flip-flop formed by NOR gates 522, 524 to reset thereby removing power from the voltage regulator 538. At the same time the logic "1" signal at Q1 of latch 540 is applied to the base of transistor 522 causing transistor 552 to saturate and remove power from the regulators 516, 518 and disable the random access memories. A capacitor 576 guarantees a pulse of a sufficient period of time for current to flow through relay coil 508*f*.

The latch 540 is also used to apply power to the Rustrak recorders 42, 44. Accordingly, a logic "1" signal on either or both the third or fourth bit DB2 or DB3 of the data bus is latched to the output of latch 540 by receipt of a $\overline{DS3}$ signal. The outputs are applied to identical regulator circuits 580, 582 through resistors 584, 586, respectively. The logic "0" at the output of the latch 540 places transistor 588 at cutoff thereby allowing current to flow through resistor 590 and the base-emitter junction of transistor 592 to regulator 594 after being filtered by capacitor 596. The output of the regulator 594 is filtered by capacitor 598 and applied to the recorder 42 (FIG. 1).

Figure 6A:
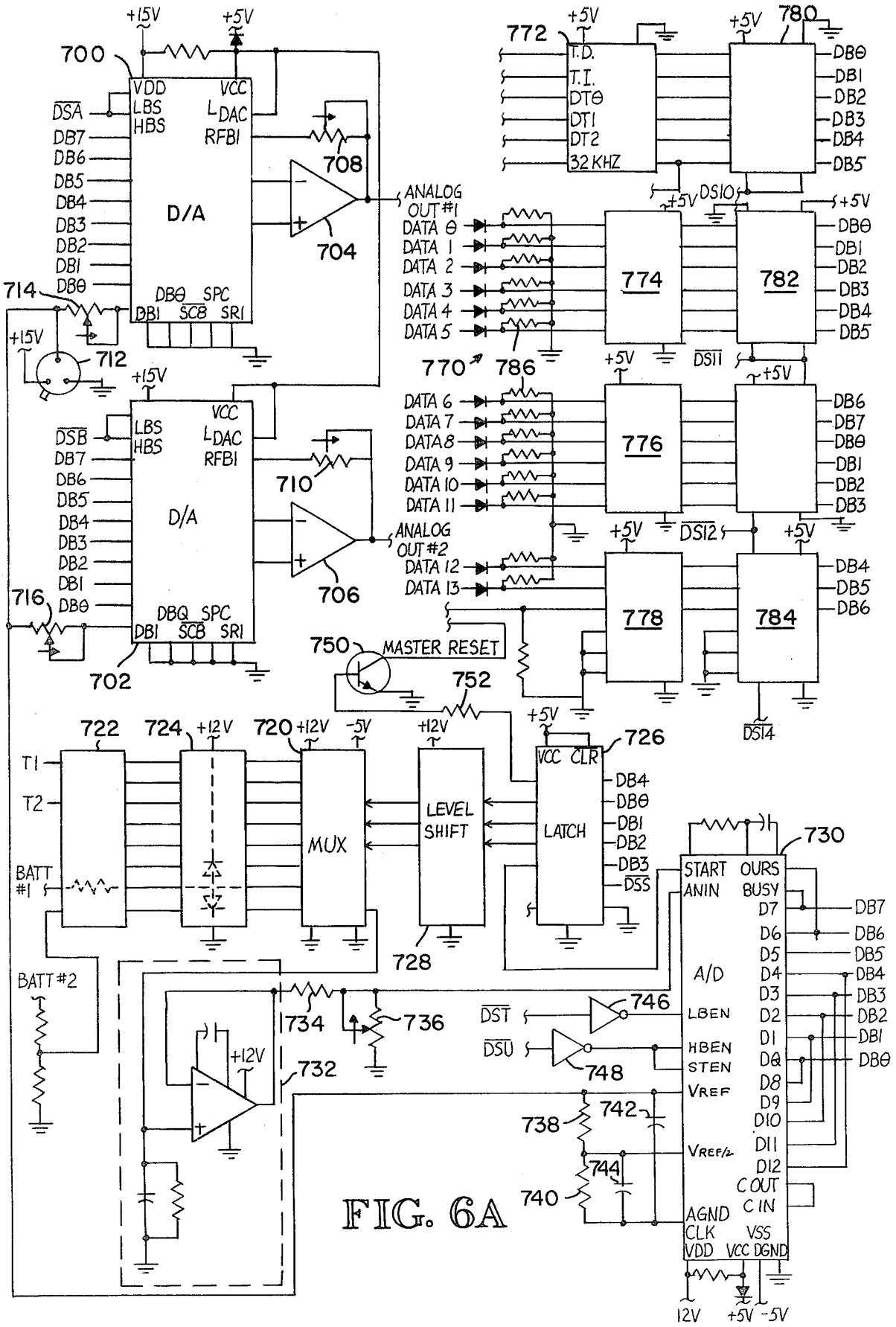
FIG. 6*a* is a schematic of digital-to-analog converters for driving external analog recorders, analog to digital converters for receiving the outputs of the temperature transducers and circuitry for receiving the output of a direct memory recorder.
Figure 6B:
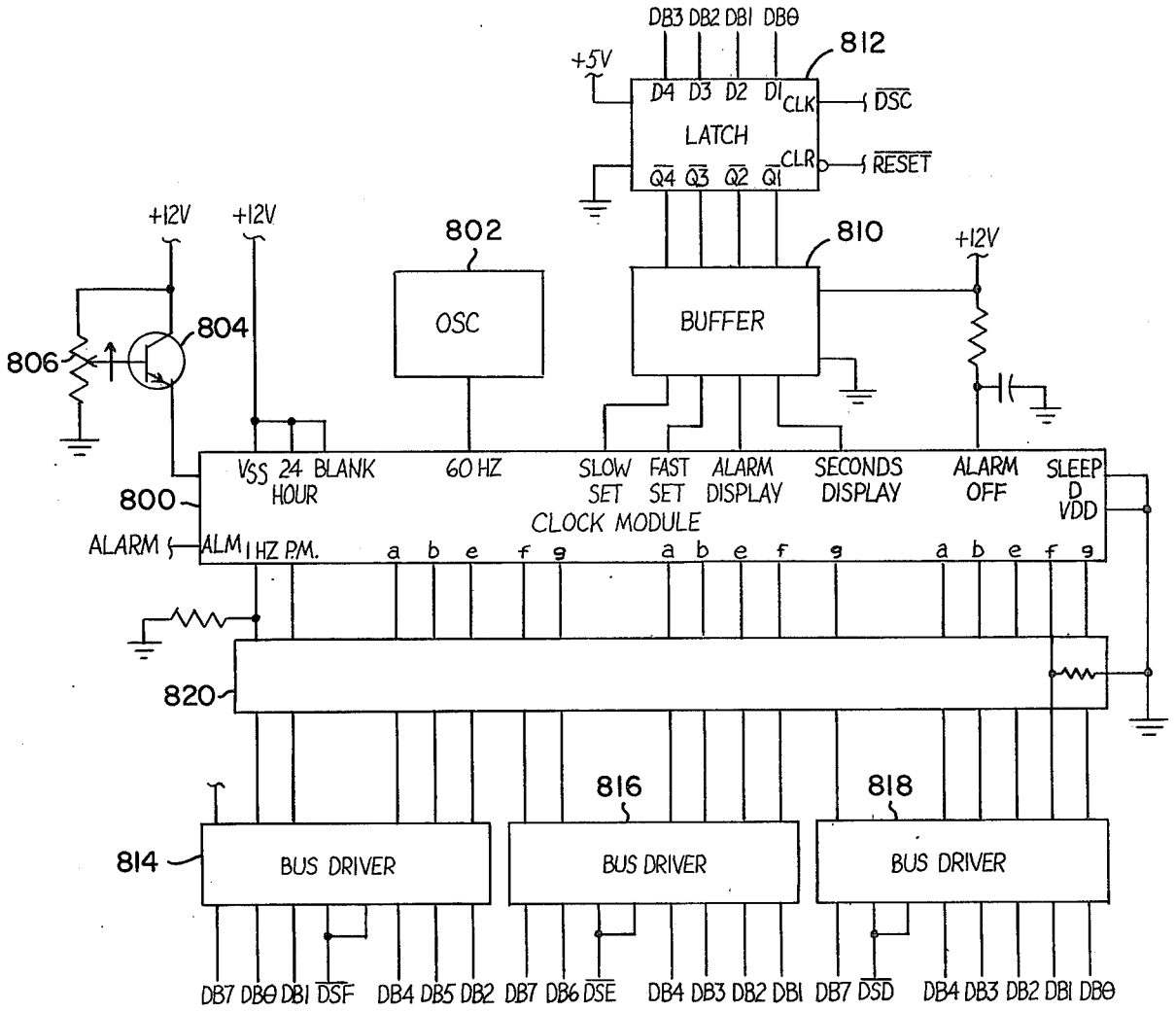
FIG. 6*b* is a schematic of the circuitry for timing the length of a quiescent period and for reapplying power to the device.

The circuitry for interfacing with the Rustrak recorders 42, 44 (FIG. 1), temperature sensors 46*b*, 48*b* and digital memory recorder 40 are illustrated in FIG. 6*a*. The signals driving the recorders 42, 44 are generated by digital to analog converters 700, 702 responsive to information on the data bus when device select signals $\overline{DSA}$ or $\overline{DSB}$ are received by the D/A converters 700, 702, respectively. The outputs of the converters 700, 702 are amplified by amplifiers 704, 706, respectively. The gains of the amplifiers 704, 706 are controlled by adjusting respective potentiometers 708, 710. Both of the D/A converters 700, 702 receive a voltage reference signal from a voltage regulator 712 through respective calibrating potentiometers 714, 716. The outputs of the amplifiers 704, 706 are connected to the Rustrak recorders 42, 44, respectively.

The outputs from the temperature sensors 46*b*, 48*b* as well as the two batteries 500, 502 (FIG. 5) are connected to a multiplexing unit 720 through resistors 722 and protective diodes 724. The multiplexer 720 selects one of the inputs to the resistors 722 as designated by the output of a latch 726 transmitted through a level shifter 728. The input designating signal from the latch 726 is received on the data bus and stored in the latch 726 along with a start signal for an analog to digital converter 730. The output of the multiplexer 720 is applied to a voltage follower circuit 732. The voltage divider ratio of resistor 734 to potentiometer 736 is adjusted to vary the scaling. The voltage reference from the voltage regulator 712 is also applied to the A/D converter, and a predetermined portion of the reference is generated between resistors 738, 740. Both reference inputs are filtered by capacitors 742, 744, respectively. The A/D converter 730 generates a 13 bit word whereas the data bus is only capable of receiving an 8 bit word. Consequently, the first 8 bits from the A/D converter 730 are applied to the data bus when a DST signal is received through inverter 746, and the remaining 5 bits are applied to the data bus when a DSU signal is received through inverter 748. Thus the output of the A to D converter is a digital signal indicative of the temperature or battery voltage as determined by the multiplexer 720.

The latch 726 also generates the master reset signal to the DMR 40 (FIG. 1) interface by applying a logic "1" signal to the base of transistor 750 through resistor 752.

Data is received from the digital memory recorder 40 (FIG. 1) through diodes 770 by level shifters 772–778 and read by the central processor through buffers 780–784, respectively, when appropriate device select signals $\overline{DS10}$–$\overline{DS14}$ are received by the buffers 780–784. The data is then transferred to the remainder of the system through the data bus. The cathodes of the diodes 770 are connected to ground through pull-down resistors 786.

A unique feature of the system is the ability to remove power from virtually the entire system during a "sleep" period as described above. For this purpose a conventional alarm clock module 800 is utilized to apply power to the system at the end of the sleep period. The module 800 includes an internal counter which is incremented by a continuously powered, 60 Hz oscillator 802. Power for the outputs only is applied to the module 800 by a transistor 804 having its base connected to the wiper of a voltage divider potentiometer 806. The potentiometer 806 is adjusted to vary the output voltage of the module 800. Information is transferred to the module 800 through a buffer 810 and a latch 812. Data on the data bus is transferred to the latch upon the occurrance of a $\underline{DSC}$, and data is cleared from the latch 812 upon receipt of a $\underline{RESET}$. The outputs of the clock module 800 are adapted to drive conventional 7-segment displays corresponding to the seconds, minutes and hours to which the module 800 is set. Other outputs include an alarm signal, a PM designating signal and a 1 Hz signal. The outputs drive bus drivers 814–818 through pull-down resistors 820. The outputs from the clock module 800 are presented to the data bus by the bus drivers 814–818 upon receipt of appropriate control signals $\overline{DSF}$–$\overline{DSD}$, respectively. The processor unit determines the time (i.e. seconds, minutes and hours) of the clock module 800 corresponding to which segments of a 7-segment display would be illuminated.

In operation, the latch 812 presents a logic "1" signal to the FAST SET input to the module 800 causing the hour counter in the clock module 800 to increment responsive to the oscillator signal. The minutes are then set in the clock 800 by producing a logic "1" on the SLOW SET input causing the minute counter to increment responsive to the signal from the oscillator 802. It should be noted that the hours must be set first since the minutes advance while the hours are being set. Finally, a signal is received on the ALARM DISPLAY input which allows the alarm to be set to a time which is a preset period after the time set in order to provide a predetermined sleep period. When the time is incremented to correspond to the alarm setting the ALARM output of the clock module 800 goes high thereby triggering the power supply circuits illustrated in FIG. 5. The clock module 800 is an MOS device which requires very little power. Since only the clock module 800, oscillator 802 and the random access memories are powered during the sleep mode the internal batteries are capable of conducting periodic tests over a relatively long period of time.

Figure 6C:
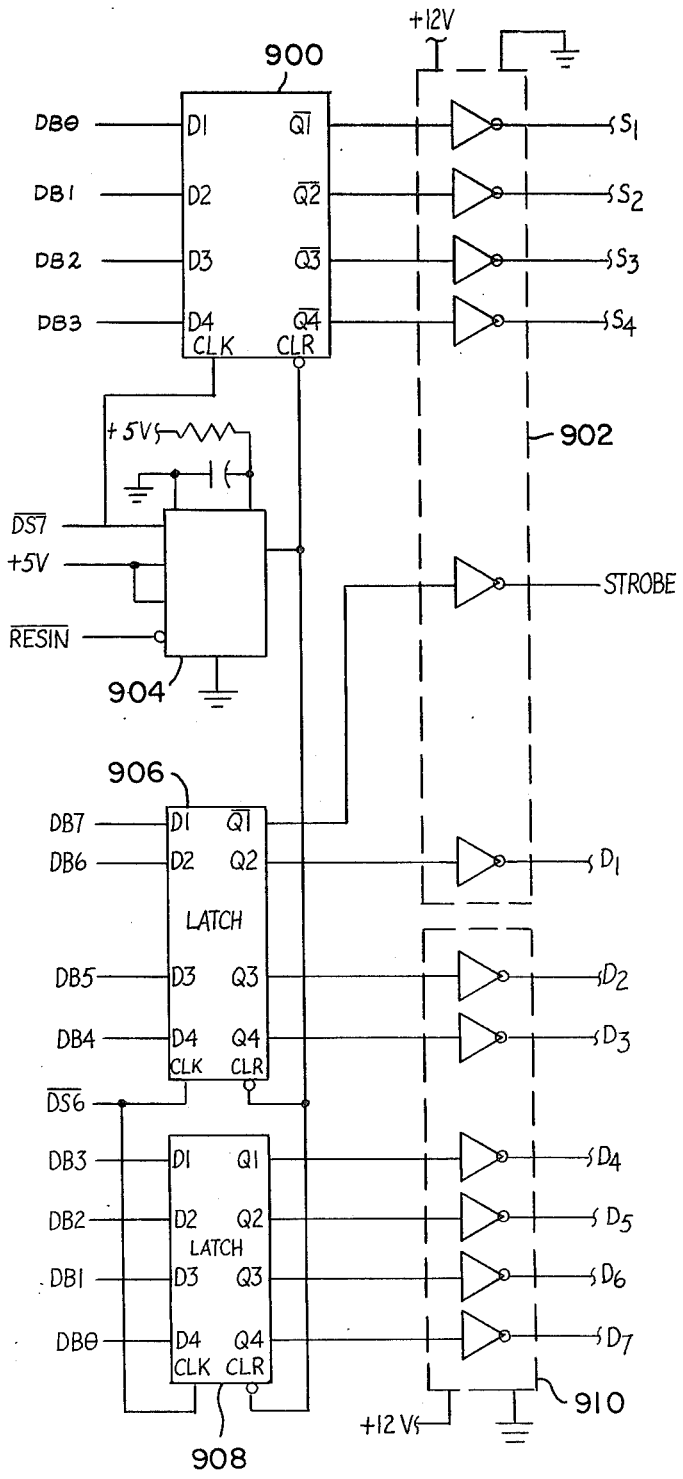
FIG. 6*c* is a schematic of the circuitry for driving the printer for recording data.

The circuitry for controlling the electronic printer is illustrated in FIG. 6*c*. Signals for driving a stepper motor in the conventional printer 20 (FIG. 1) are generated by a latch 900 and transmitted to the stepper motor through level shifters 902. Data is recorded by the latch 900 from the data bus responsive to a $\overline{DS7}$ signal. The $\overline{DS7}$ signal also actuates a one-shot 904 which clears the latch 900 after a predetermined period in order to terminate the stepper signals S1–S4 after a predetermined period thereby protecting the motor components against excessively long duration currents. The information printed by the printer is recorded by latches 906, 908 from the data bus responsive to a $\overline{DS6}$ signal thereby driving data outputs through level shifters 902 and 910. At the same time a STROBE signal is produced by the latch 906. The printer utilizes a heat sensitive paper and a printer head which is connected to the stepper motor for moving the head across the surface of the paper. For each location of the head a predetermined combination of heater elements are enabled as determined from the ASCII data on the data lines D1–D7 and the heaters are actuated by the STROBE signal.

The program stored in the read only memories 340–350 is as follows:

```
0000H=31H FFH 24H AFH C3H 43H 00H FFH CDH CBH 0CH C3H 77H 0CH FFH FFH
0010H=0EH 04H C3H BEH 0DH FFH FFH FFH 0EH 05H 1AH 77H 23H 13H 0DH C2H
0020H=1AH 00H C9H FFH FFH FFH FFH FFH C3H E6H 05H FFH FFH FFH FFH FFH
0030H=0EH 12H CDH 1AH 00H C3H CBH 11H C3H 02H 0BH 00H 00H 00H 00H 00H
0040H=00H 00H 00H 3AH DEH 20H FEH 53H C2H 51H 00H CDH 4FH 01H 32H FEH
0050H=20H AFH 32H DCH 20H 32H FBH 20H 3EH 11H 32H DBH 20H 21H 01H 00H
0060H=22H F9H 20H CDH A1H 13H 0EH 55H 21H 50H 20H 7EH B7H 27H BEH CAH
0070H=74H 00H 36H 00H 23H 0DH C2H 6BH 00H 3AH DEH 20H FEH 53H CAH 62H
0080H=18H 3EH 25H 32H FCH 20H 0EH 28H 21H A5H 20H 36H 00H 23H 0DH C2H
0090H=8BH 00H 3EH 10H 32H 82H 20H 32H 87H 20H 32H AAH 20H CDH 0AH 12H
00A0H=11H 68H 0CH 21H CDH 20H DFH 3EH 5CH 32H 2FH 20H 3EH 54H 32H 30H
00B0H=20H 0EH 03H FBH EFH 0DH C2H B4H 00H 21H EDH 20H 36H 00H 23H 22H
00C0H=EBH 20H 11H 3BH 00H 21H D3H 20H 0EH 06H CDH 1AH 00H 3CH 32H DFH
00D0H=20H 32H D2H 20H 31H FFH 24H AFH D3H 03H 32H F7H 20H 32H F8H 20H
00E0H=CDH A1H 13H 3EH 39H 32H 30H 20H FBH 1EH 00H CFH F5H CDH A1H 13H
00F0H=F1H B7H CAH 40H 11H 3DH CAH F8H 1AH 3DH CAH 29H 01H D6H 03H CAH
0100H=5CH 01H 3DH CAH F6H 05H 3DH CAH 30H 03H 3DH CAH A3H 19H 3DH CAH
0110H=86H 1BH 3DH CAH 8AH 1CH 3DH CAH 4DH 17H 3DH CCH 0AH 12H 3DH CAH
0120H=9FH 12H 3DH CAH A7H 15H C3H D4H 00H 3EH 0CH 32H 3AH 20H 1EH 05H
0130H=CDH CBH 0CH CDH F4H 12H 0EH 04H 21H CEH 20H AFH BEH C2H D4H 00H
0140H=23H 0DH C2H 3CH 01H 11H 68H 0CH 21H CDH 20H DFH C3H D4H 00H 21H
0150H=00H 20H 0EH FFH 7EH 23H 86H 0DH C2H 55H 01H C9H CDH A2H 05H C6H
0160H=02H 32H 3AH 20H 1EH 0EH CDH CBH 0CH CDH F9H 12H CAH D4H 00H F5H
0170H=CDH A1H 13H 21H EEH 20H 06H 09H 16H DFH 3AH 3AH 20H FEH 03H CAH
0180H=84H 01H 16H EFH 7AH A6H 77H 23H 05H C2H 84H 01H F1H B7H FAH D4H
0190H=00H D5H 1EH 0DH CFH D1H 21H EEH 20H 3DH CAH A1H 01H 23H C3H 99H
01A0H=01H 7AH 2FH B6H 77H C3H D4H 00H 21H EDH 20H 46H 05H F8H 23H 7EH
01B0H=E6H 30H CAH ACH 01H 7EH E6H 03H C0H 7EH F5H C5H E5H 01H 00H 00H
01C0H=E6H 10H CAH C7H 01H 0EH 0AH C5H CDH 34H 1AH CDH A8H 11H DAH BAH
01D0H=02H 21H 00H 20H DFH 11H 00H 20H 21H 6EH 20H C1H C5H 09H CDH B6H
01E0H=0EH D2H BAH 02H 11H 13H 20H 21H 00H 20H DFH 11H 00H 20H 21H 73H
```

01F0H=20H C1H C5H 09H CDH B6H 0EH DAH BEH 02H 11H 13H 20H 21H 6EH 20H

0200H=C1H C5H 09H CDH B6H 0EH 11H 13H 20H 21H 34H 20H DFH 21H 73H 20H

0210H=11H 13H 20H C1H C5H 09H EBH DFH 11H 13H 20H 21H 6EH 20H C1H C5H

0220H=09H CDH B6H 0EH 11H 34H 20H 21H 13H 20H CDH 29H 0EH 11H 4BH 20H

0230H=21H 1DH 20H DFH 11H C3H 02H CDH 36H 0FH 11H 27H 20H 21H 3CH 20H

0240H=DFH 21H 3DH 20H CDH A8H 0DH 3AH 3CH 20H FEH 03H CAH 5AH 02H 47H

0250H=3EH 03H 90H 47H 21H 40H 20H CDH 66H 10H 21H 30H 20H 7EH 07H 07H

0260H=07H 07H E6H 0FH 47H AFH 05H FAH 6FH 02H C6H 64H C3H 66H 02H 4FH

0270H=7EH E6H 0FH 47H 79H 05H FAH 7EH 02H C6H 0AH C3H 75H 02H 4FH 23H

0280H=7EH 07H 07H 07H 07H E6H 0FH 47H 79H 05H FAH 91H 02H 3CH C3H 89H

0290H=02H 57H C1H AFH B9H 7AH C2H B3H 02H D3H 0AH 06H 04H 3AH F8H 20H

02A0H=B0H 32H F8H 20H D3H 03H E1H C1H F1H E6H 30H D6H 30H C2H ACH 01H

02B0H=C3H BAH 01H D3H 0BH 06H 08H C3H 9DH 02H AFH C3H 91H 02H 3EH F9H

02C0H=C3H 91H 02H 03H 24H 90H 00H 00H 11H 60H F0H AFH CDH 2BH 03H D2H

02D0H=D7H 02H C6H 10H C3H CCH 02H 2AH 20H 20H 11H 70H FEH CDH 2BH 03H

02E0H=D2H E7H 02H 3CH C3H DDH 02H 32H 1EH 20H 2AH 20H 20H 11H D8H FFH

02F0H=AFH CDH 2BH 03H D2H FCH 02H C6H 10H C3H F1H 02H 2AH 20H 20H 11H

0300H=FCH FFH CDH 2BH 03H D2H 0CH 03H 3CH C3H 02H 03H 32H 1FH 20H AFH

0310H=2AH 20H 20H 2DH FAH 1DH 03H C6H 25H 27H C3H 13H 03H 32H 20H 20H

0320H=AFH 32H 21H 20H 3EH 02H 11H 1DH 20H 12H C9H 22H 20H 20H 19H C9H

0330H=CDH A2H 05H 32H 3AH 20H 1EH 07H CFH F5H 3EH 01H CDH D9H 04H CDH

0340H=C8H 02H 3AH 3AH 20H FEH 01H CAH 5DH 03H 21H 34H 20H DFH 3EH 00H

0350H=CDH D9H 04H 29H CDH C8H 02H 21H 34H 20H CDH B6H 0EH 11H 1DH 20H

0360H=F1H FEH FFH C8H FEH 0DH CAH 72H 03H CDH A9H 18H AFH F5H EFH C3H

0370H=3AH 03H CDH 26H 0DH CDH CBH 11H C3H D4H 00H 42H 41H 54H 54H 45H

0380H=52H 59H 20H 23H 20H 20H 46H 41H 49H 4CH 55H 52H 45H FBH 3EH 01H

0390H=CDH D9H 04H 3EH 0AH BCH 3EH 31H D2H A9H 03H AFH CDH D9H 04H 3EH

03A0H=0AH BCH 7CH 32H FDH 20H D8H 3EH 32H F5H CDH 6BH 0DH 0EH 12H 11H

03B0H=7BH 03H 21H 0BH 20H CDH 1AH 00H F1H 32H 14H 20H CDH CBH 11H CDH

03C0H=37H 1CH C3H A1H 0BH 3EH 01H D3H 0CH CDH E1H 05H 21H 27H 20H 22H

03D0H=08H 20H CDH C3H 04H CDH DCH 05H DBH 0DH E6H 1FH 06H 00H CDH 87H

03E0H=04H 32H 05H 20H DBH 0EH E6H 1EH 47H DBH 0DH 07H E6H 01H CDH 87H

03F0H=04H 32H 04H 20H CDH E1H 05H DBH 0EH 07H 07H E6H 03H 47H DBH 0FH

0400H=E6H 1CH CDH 87H 04H F6H 80H 32H 03H 20H AFH D3H 0CH CDH 43H 04H

0410H=21H DEH 20H 3EH 4EH BEH 36H 00H CAH 38H 04H 0EH 06H 21H 22H 20H

0420H=11H D3H 20H 1AH BEH DAH 38H 04H C2H 31H 04H 13H 23H 0DH C2H 23H

0430H=04H 21H D2H 20H 7EH 3CH 27H 77H 11H 22H 20H 21H D3H 20H 0EH 06H

0440H=C3H 1AH 00H CDH E1H 05H DBH 0DH 07H E6H 01H 47H DBH 0EH E6H 1EH

```
0450H=CDH 87H 04H 32H 02H 20H CDH C3H 05H DBH 0EH 07H 07H E6H 03H 47H
0460H=DBH 0FH E6H 1CH CDH 87H 04H F6H 80H 32H 01H 20H 0EH 41H 16H 00H
0470H=DBH 0FH E6H 03H EEH 01H B2H 57H CDH C3H 05H 0DH C2H 70H 04H 47H
0480H=CDH A8H 04H 32H 00H 20H C9H 80H 06H 00H 21H 9EH 04H BEH CAH A8H
0490H=04H 4FH 04H 78H FEH 0AH 79H CAH A8H 04H 23H C3H 8DH 04H 1EH 08H
04A0H=1DH 19H 0BH 13H 17H 18H 1FH 1BH 2AH 08H 20H 70H 2BH 22H 08H 20H
04B0H=48H 06H 00H 21H B9H 04H 09H 7EH C9H 3FH 06H 5BH 4FH 66H 6DH 7DH
04C0H=07H 7FH 67H DBH 0DH E6H 1FH 47H DBH 0DH E6H 1FH B8H C0H 47H C3H
04D0H=C8H 04H 3EH 06H C2H F5H 04H 3EH 07H F5H CDH F5H 04H F1H F5H E5H
04E0H=CDH F5H 04H C1H 78H BCH C2H DDH 04H 09H 7CH B7H 1FH 67H 7DH 1FH
04F0H=E6H FCH 6FH F1H C9H F5H 3EH 05H CDH 11H 05H F1H E5H CDH 11H 05H
0500H=C1H 78H 2FH 47H 79H 2FH 4FH 03H 09H 7CH E6H F0H C8H 21H 00H 00H
0510H=C9H D5H 57H 21H 00H 30H 77H CDH DCH 05H F6H 08H 77H 72H CDH E1H
0520H=05H 3AH 00H 38H B7H FAH 21H 05H E6H 0FH 67H 3AH 00H 34H E6H FCH
0530H=6FH D1H C9H 01H 00H 80H DBH 0FH A7H F2H 44H 05H 0BH 78H B1H C2H
0540H=36H 05H 37H C9H E5H 21H 01H 20H 0EH 02H 3EH 10H D3H 05H 34H DBH
0550H=09H E6H 0FH 07H 07H 07H 07H 47H AFH D3H 05H 3EH 08H D3H 05H AFH
0560H=D3H 05H 34H DBH 09H E6H 0FH 80H 77H 23H 3EH 08H D3H 05H AFH D3H
0570H=05H 34H DBH 09H E6H 0FH 07H 07H 07H 07H 47H 0DH C2H 5BH 05H 47H
0580H=DBH 08H E6H F0H 07H 07H 07H 07H 80H 77H 23H DBH 08H E6H 0FH 07H
0590H=07H 07H 07H 77H 3EH 02H 32H 00H 20H E1H C9H 06H 00H 5CH 50H 00H
05A0H=5BH 00H 0EH 07H 11H 9BH 05H 21H 2DH 20H CDH 1AH 00H 1EH 01H CFH
05B0H=F5H F5H CDH A1H 13H F1H 3DH 3EH 06H CAH BEH 05H 3EH 5BH 32H 30H
05C0H=20H F1H C9H 06H 0AH C3H E8H 05H 3AH FDH 20H 07H 47H 3AH FCH 20H
05D0H=90H FEH 12H DAH D8H 05H 3EH 0CH 47H C3H E8H 05H 06H 14H C3H E8H
05E0H=05H 06H 32H C3H E8H 05H 06H C8H C5H 0EH B4H 0DH 0DH C2H EBH 05H
05F0H=05H C2H E9H 05H C1H C9H 1EH 08H CFH C2H 6BH 06H 5FH DBH 14H E6H
0600H=40H C2H D4H 00H 7BH FEH 05H D2H 41H 06H 32H 3AH 20H AFH 32H F7H
0610H=20H 1EH 11H CFH 21H F7H 20H FEH 02H C2H 23H 06H 7EH F6H 01H 77H
0620H=C3H 11H 06H FEH 03H C2H 80H 06H 7EH F6H 02H 77H C3H 11H 06H 20H
0630H=20H 20H 20H 44H 4DH 52H 20H 50H 52H 45H 53H 45H 54H 20H 20H 20H
0640H=20H 21H 2FH 20H 36H 39H 23H 36H 38H 23H 36H 50H 1EH 03H CFH FEH
0650H=0DH C2H D4H 00H 3EH 08H D3H 13H 3EH 0AH EFH 3DH C2H 5AH 06H D3H
0660H=13H 11H 2FH 06H 21H 0BH 20H F7H C3H D4H 00H 1EH 04H CDH CBH 0CH
0670H=3EH 09H 32H 3AH 20H CDH FEH 12H 3EH 10H 32H AAH 20H C3H D4H 00H
0680H=CDH CAH 08H 3EH 04H D3H 13H 3EH 10H 32H 00H 30H EFH AFH 32H 00H
0690H=30H EFH 21H ADH 20H CDH 0DH 11H 11H 3BH 00H 21H 87H 20H DFH 3EH
06A0H=15H 32H 8AH 20H AFH 32H 0AH 20H 32H DEH 20H CDH D0H 06H 21H 00H
```

06B0H=00H DBH 10H 1FH D2H BDH 06H CDH 16H 07H C3H B1H 06H DBH 10H 1FH

06C0H=DAH D4H 00H 17H D4H 07H 07H DCH 2FH 07H CDH 16H 07H C3H BDH 06H

06D0H=11H A5H 20H 21H 05H 20H DFH 06H 00H 3AH 05H 20H 4FH 0DH FAH FCH

06E0H=06H 3AH 06H 20H E6H F0H 07H 07H 07H 07H 57H 78H 07H 5FH 07H 07H

06F0H=83H 82H 47H C5H 21H 05H 20H D7H C1H C3H DDH 06H 68H 26H 00H 29H

0700H=29H 29H 23H 22H E7H 20H C9H DBH 10H 2FH E6H 02H 47H 3AH 0AH 20H

0710H=90H 78H 32H 0AH 20H C9H 3EH 04H D3H 13H AFH D3H 13H CDH 28H 07H

0720H=CDH 07H 07H 3EH 04H D3H 13H 23H 3EH 04H 3DH C2H 2AH 07H C9H E5H

0730H=2AH E7H 20H 7CH B5H CAH 41H 07H 2BH 22H E7H 20H 7CH B5H C2H E3H

0740H=07H 3EH 05H D3H 13H 3EH 07H D3H 13H F5H F1H 3EH 05H D3H 13H CDH

0750H=C3H 05H DBH 11H 6FH DBH 12H 67H 3EH 04H D3H 13H 3AH 3AH 20H 3DH

0760H=C2H 6EH 07H 3EH 0FH A4H 67H 3EH F8H A5H 6FH C3H 89H 07H 3DH C2H

0770H=79H 07H 3EH 0FH A4H 67H C3H 89H 07H 47H DBH 10H 2FH E6H 1CH 78H

0780H=C2H 2CH 00H 7CH E6H 03H 67H 29H 29H CDH C8H 02H 21H 06H 0AH DBH

0790H=10H 2FH 0FH 0FH E6H 07H F5H CAH A2H 07H 01H 05H 00H 09H 3DH C2H

07A0H=9DH 07H EDH CDH 36H 0FH 11H 27H 20H CDH 26H 0DH F1H CAH C7H 07H

07B0H=3AH F7H 20H B7H CAH E3H 07H 11H 27H 20H 21H 13H 20H DFH CDH 3DH

07C0H=0CH CDH 26H 0DH C3H E3H 07H 3AH F7H 20H 0FH D2H D7H 07H 11H 27H

07D0H=20H CDH 68H 1BH CDH 26H 0DH 3EH 54H 32H 14H 20H 11H 27H 20H 21H

07E0H=00H 24H DFH 3AH DEH 20H 3DH 32H DEH 20H F2H 1FH 08H 3EH 07H 32H

07F0H=DEH 20H E1H 7DH E6H FCH B4H CAH 08H 08H 2BH 2BH 2BH 2BH E5H 21H

0800H=E0H 20H CDH B2H 10H C3H F2H 07H 2AH E7H 20H 7CH B5H C2H 1BH 08H

0810H=21H E0H 20H 11H 0BH 20H 06H 30H CDH 63H 1CH 21H 00H 00H C9H 2AH

0820H=E7H 20H 7CH B5H C2H 2AH 08H CDH CBH 11H E1H C9H 3DH C2H 32H 08H

0830H=29H 29H 7CH E6H 3FH 67H CDH 42H 08H CDH EDH 0BH CDH 26H 0DH C3H

0840H=E3H 07H CDH 79H 08H 11H A0H 20H 21H 18H 20H DFH 11H 18H 20H 21H

0850H=34H 20H CDH B6H 0EH DAH 5EH 08H CDH E0H 0BH C3H D4H 00H CDH A1H

0860H=13H 21H 34H 20H 36H 07H 23H 36H 40H 2BH EBH 21H 18H 20H CDH 29H

0870H=0EH 11H 4BH 20H 21H 00H 20H DFH C9H CDH A1H 13H 06H 10H CDH A8H

0880H=08H 7DH 17H 6FH 7CH 17H 67H DCH 94H 08H 05H C2H 7EH 08H 3EH 06H

0890H=32H 34H 20H C9H 11H 37H 20H CDH A1H 08H D0H 1BH CDH A1H 08H D0H

08A0H=1BH B7H 1AH C6H 01H 27H 12H C9H 0EH 03H 11H 37H 20H B7H 1AH 8FH

08B0H=27H 12H 1BH 0DH C2H AEH 08H C9H 20H 20H 20H 20H 44H 4DH 52H 20H

08C0H=54H 59H 50H 45H 20H 23H 20H 20H 20H 20H CDH D1H 15H 11H B8H 08H

08D0H=21H 0BH 20H 0EH 12H CDH 1AH 00H 3AH 3AH 20H C6H 30H 32H 19H 20H

08E0H=CDH CBH 11H 3AH 3AH 20H FEH 03H DAH 00H 09H 11H 50H 20H 21H 8AH

08F0H=09H CDH 63H 09H 11H AFH 20H CDH 63H 09H 11H A0H 20H CDH 63H 09H

0900H=11H DBH 09H 21H 0BH 20H 0EH 12H CDH 1AH 00H 3AH F7H 20H 0FH DAH

0910H=17H 09H 3EH 46H 32H 19H 20H CDH CBH 11H 3AH F7H 20H FEH 01H C2H

0920H=3BH 09H 3AH D1H 20H E6H 0FH C2H 3BH 09H 11H CDH 20H CDH 26H 0DH

0930H=11H EDH 09H 21H 0BH 20H 0EH 0AH C3H 5AH 09H 11H 07H 00H 21H 4AH

0940H=15H 3DH FAH 49H 09H 19H C3H 41H 09H EBH 21H 14H 20H 0EH 07H CDH

0950H=1AH 00H 11H F7H 09H 21H 0BH 20H 0EH 09H CDH 1AH 00H CDH CBH 11H

0960H=C3H D1H 15H 0EH 03H C5H D5H E5H E5H CDH 26H 0DH D1H 21H 0BH 20H

0970H=0EH 09H CDH 1AH 00H CDH CBH 11H E1H D1H 01H 09H 00H 09H EBH 01H

0980H=05H 00H 09H EBH C1H 0DH C2H 65H 09H C9H 50H 31H 58H 20H 20H 20H

0990H=20H 3DH 20H 50H 31H 59H 20H 20H 20H 20H 3DH 20H 50H 31H 5AH 20H

09A0H=20H 20H 20H 3DH 20H 50H 31H 54H 58H 20H 20H 20H 3DH 20H 50H 31H

09B0H=54H 59H 20H 20H 20H 3DH 20H 50H 31H 54H 5AH 20H 20H 20H 3DH 20H

09C0H=50H 52H 45H 53H 45H 54H 20H 3DH 20H 53H 4BH 49H 50H 20H 20H 20H

09D0H=3DH 20H 42H 49H 41H 53H 20H 20H 20H 3DH 20H 54H 45H 4DH 50H 2EH

09E0H=20H 49H 4EH 20H 44H 45H 47H 2EH 20H 43H 20H 20H 20H 50H 20H 3DH

09F0H=20H 50H 53H 49H 20H 58H 20H 50H 52H 45H 53H 2EH 20H 49H 4EH 20H

0A00H=50H 32H 58H 20H 20H 20H 20H 3DH 20H 50H 32H 59H 20H 20H 20H 20H

0A10H=3DH 20H 50H 32H 5AH 20H 20H 20H 20H 3DH 20H 50H 32H 54H 58H 20H

0A20H=20H 20H 3DH 20H 50H 32H 54H 59H 20H 20H 20H 3DH 20H 50H 32H 54H

0A30H=5AH 20H 20H 20H 3DH 20H 54H 31H 58H 20H 20H 20H 20H 3DH 20H 54H

0A40H=31H 59H 20H 20H 20H 20H 3DH 20H 54H 32H 58H 20H 20H 20H 20H 3DH

0A50H=20H 54H 32H 59H 20H 20H 20H 20H 3DH 20H 41H 4EH 41H 2EH 31H 20H

0A60H=4CH 46H 3DH 41H 4EH 41H 2EH 31H 20H 52H 54H 3DH 41H 4EH 41H 2EH

0A70H=32H 20H 4CH 46H 3DH 41H 4EH 41H 2EH 32H 20H 52H 54H 3DH 2AH 20H

0A80H=2AH 20H 2AH 20H 2AH 3DH 02H 25H 00H 00H 00H 02H 25H 00H 00H 00H

0A90H=02H 50H 00H 00H 00H 03H 10H 00H 00H 00H 03H 25H 00H 00H 00H 03H

0AA0H=50H 00H 00H 00H 04H 10H 00H 00H 00H 04H 25H 00H 00H 00H 21H EDH

0AB0H=20H 46H 05H F8H 23H 7EH E6H 40H CAH B2H 0AH 7EH E6H 03H C2H DAH

0AC0H=0AH 7EH E6H 0CH 0FH 0FH 32H F7H 20H 7EH 07H DAH D4H 0AH CDH 40H

0AD0H=19H C3H 0CH 17H CDH 9EH 19H C3H 30H 17H 3DH C2H EDH 0AH 7EH 07H

0AE0H=3EH 07H CEH 00H 32H 3AH 20H CDH 3DH 1BH C3H A9H 18H 3DH C8H 7EH

0AF0H=07H 3EH 01H CEH 00H 32H 3AH 20H 21H A9H 18H E5H 3EH FFH F5H C3H

0B00H=3AH 03H F5H C5H D5H E5H 01H 2CH 20H 3AH DBH 20H 07H DAH 14H 0BH

0B10H=03H C3H 0CH 0BH 21H 00H 2CH 0AH E6H 0FH 77H AFH 77H 03H 03H 03H

0B20H=03H 0AH 21H 00H 28H E6H 0FH 77H AFH 77H 3AH DBH 20H 07H 32H DBH

0B30H=20H D3H 00H 01H 2CH 20H 07H DAH 3EH 0BH 03H C3H 36H 0BH 21H 00H

0B40H=2CH 0AH E6H 0FH 77H 0AH 77H 03H 03H 03H 03H 21H 00H 28H 0AH E6H

0B50H=0FH 77H 0AH 77H 2AH F9H 20H 2BH 22H F9H 20H 7CH B5H C2H 6AH 0BH

0B60H=21H FBH 20H B6H C2H 96H 0BH CDH 8DH 03H 21H FBH 20H DBH 01H E6H

```
0B70H=5FH D6H 41H C2H 7EH 0BH B6H CAH D4H 00H 3EH 02H B6H 77H DBH 01H
0B80H=E6H 5FH D6H 10H C2H C5H 0BH 3AH 30H 20H D6H 54H CAH C5H 0BH 7EH
0B90H=B7H CAH A1H 0BH F6H 04H 77H C3H C5H 0BH 3EH 01H B6H 77H C3H 6AH
0BA0H=0BH F3H CDH A1H 13H 3EH 3FH 32H 00H 2CH 3EH 71H 32H 00H 28H 3EH
0BB0H=1CH D3H 00H 0EH 05H EFH 0DH C2H B5H 0BH AFH D3H 00H 32H DEH 20H
0BC0H=3EH 03H D3H 03H 76H E1H D1H C1H F1H FBH C9H CDH A1H 13H 21H 2EH
0BD0H=20H 11H D6H 0BH DFH C9H 79H 50H 50H 5CH 50H 45H 52H 52H 4FH 52H
0BE0H=CDH 6BH 0DH 21H 18H 20H 11H DBH 0BH DFH C3H CBH 11H AFH 21H 00H
0BF0H=00H C3H F9H 0BH 3EH 01H 21H 0FH 00H F5H E5H C1H 11H 55H 20H 19H
0C00H=E5H 11H 50H 20H C5H E1H 19H E5H 11H 5AH 20H C5H E1H 19H E5H D1H
0C10H=21H 00H 20H CDH 29H 0EH CDH 1CH 0FH 21H 13H 20H D1H CDH 12H 0FH
0C20H=21H 18H 20H D1H E5H CDH 12H 0FH E1H E5H D1H E5H CDH 12H 0FH 11H
0C30H=13H 20H E1H CDH B6H 0EH 11H 13H 20H F1H CDH 94H 1AH 3AH F7H 20H
0C40H=B7H C8H 21H CDH 20H 3DH CAH 57H 0CH 11H 05H 00H 21H 6DH 0CH 3DH
0C50H=CAH 57H 0CH 19H C3H 4FH 0CH 11H 1DH 20H EBH DFH 21H 13H 20H E5H
0C60H=D1H CDH 12H 0FH 11H 13H 20H C9H 00H 07H 03H 07H 01H 02H 27H 72H
0C70H=90H 00H 02H 70H 43H 00H 00H DBH 01H E6H 5FH FEH 13H CAH 85H 0CH
0C80H=E6H 50H C2H 77H 0CH DBH 01H 4FH E6H 50H CAH 85H 0CH CDH E1H 05H
0C90H=DBH 01H 47H B9H C2H 85H 0CH DBH 02H B7H F2H 85H 0CH 79H 2FH E6H
0CA0H=0FH 4FH 78H E6H 10H F5H 79H 21H E7H 20H CAH AFH 0CH 23H 23H FEH
0CB0H=08H DAH B7H 0CH 23H D6H 08H 47H 7EH 07H 05H F2H B9H 0CH D2H C7H
0CC0H=0CH F1H 79H F5H EFH F1H C9H F1H C3H 85H 0CH 16H 00H 7BH 07H 07H
0CD0H=5FH 21H DEH 0CH 19H 11H E7H 20H 0EH 04H EBH C3H 1AH 00H 00H 00H
0CE0H=E7H FEH 60H 00H 00H 00H 00H 38H 00H 06H FFH FDH 00H 00H 00H 38H
0CF0H=00H 00H 00H 20H 00H 00H 00H 30H 20H 06H 00H 00H 00H 06H 78H 08H
0D00H=00H 40H 00H 20H 00H 06H FFH C0H C1H 80H 00H 04H 20H 00H 00H 04H
0D10H=30H 00H 7FH C0H 00H 00H 00H 38H 00H 80H 00H 38H 70H 06H 00H 28H
0D20H=00H 04H 00H 00H 30H 04H CDH 7CH 0DH CDH 6BH 0DH 21H 15H 20H 36H
0D30H=00H 11H 05H 20H 1AH E6H 80H CAH 3CH 0DH 36H 2DH 23H 1AH 13H E6H
0D40H=7FH 47H 0EH 06H B7H CCH 67H 0DH 79H E6H 01H 1AH C2H 58H 0DH E6H
0D50H=F0H 07H 07H 07H 07H C3H 5BH 0DH 13H E6H 0FH C6H 30H 77H 23H 05H
0D60H=78H 0DH C2H 44H 0DH B7H C0H 36H 2EH 23H C9H C5H E5H 21H 0BH 20H
0D70H=0EH 12H 36H 00H 23H 0DH C2H 72H 0DH E1H C1H C9H 21H 05H 20H 0FH
0D80H=21H 05H 20H 3EH 10H BEH 23H C4H A8H 0DH 21H 05H 20H 7EH 23H 4FH
0D90H=E6H 40H C8H 79H 2FH 3CH E6H 3FH 47H 21H 09H 20H CDH 66H 10H 21H
0DA0H=05H 20H 3EH 80H A6H 77H 23H C9H 06H 08H 22H D9H 20H 2AH D9H 20H
0DB0H=7EH E6H F0H C0H 2BH D7H 05H C2H ADH 0DH 2BH 36H 00H C9H C5H C5H
0DC0H=7EH E6H 7FH 3DH E6H 7FH 47H 7EH E6H 80H B0H 77H 23H C1H 7EH E6H
```

```
0DD0H=0FH 0DH CAH E5H 0DH 47H 23H 7EH E6H F0H 2BH 80H 07H 07H 07H 07H
0DE0H=77H 23H C3H CEH 0DH 07H 07H 07H 07H 77H C1H C9H E5H 21H 3CH 20H
0DF0H=DFH D1H 21H 41H 20H DFH 21H 3CH 20H 7EH E6H 7FH 77H 21H 41H 20H
0E00H=7EH E6H 7FH 77H 21H 42H 20H CDH A8H 0DH CCH CBH 0BH CAH 04H 0EH
0E10H=21H 3DH 20H CDH A8H 0DH 3AH 3CH 20H 21H 41H 20H 96H 3CH E6H 7FH
0E20H=32H DDH 20H AFH 77H 32H 3CH 20H C9H D5H E5H CDH ECH 0DH 21H 46H
0E30H=20H 11H 3CH 20H DFH 21H 4BH 20H 11H 3BH 00H DFH 21H 4CH 20H E5H
0E40H=AFH F5H 16H 08H D5H 11H 3CH 20H 21H 3CH 20H 06H 00H DFH 11H 3CH
0E50H=20H 21H 41H 20H C5H CDH B6H 0EH C1H DAH 9AH 0EH D1H F1H E1H A7H
0E60H=C2H 6EH 0EH 78H 07H 07H 07H 07H 77H 3EH 01H C3H 73H 0EH 7EH 80H
0E70H=77H AFH 23H 15H CAH A5H 0EH E5H F5H D5H 11H 46H 20H 3AH 47H 20H
0E80H=E6H F0H C2H 92H 0EH 0EH 04H 21H 48H 0EH E5H E5H 21H 47H 20H C3H
0E90H=CEH 0DH 1AH 3CH E6H 7FH 12H C3H 48H 0EH 04H 21H 46H 20H 11H 3CH
0EA0H=20H DFH C3H 4EH 0EH D1H E1H 1AH E6H 80H 86H E6H 80H 47H 3AH DDH
0EB0H=20H 80H 32H 4BH 20H C9H D5H E5H 21H 27H 20H DFH D1H 21H 22H 20H
0EC0H=DFH 21H 22H 20H 7EH EEH 80H 77H 06H 01H CDH 35H 10H 1AH E6H 80H
0ED0H=37H CAH D5H 0EH B7H E1H E5H DFH D1H C9H 7DH C6H 04H 6FH 7BH C6H
0EE0H=04H 5FH 0EH 04H 37H 3EH 99H CEH 00H 96H EBH 86H 27H 77H EBH 1BH
0EF0H=2BH 0DH C2H E5H 0EH 3AH 3BH 20H 12H C9H CDH DAH 0EH D8H F6H 80H
0F00H=32H 3BH 20H D5H 11H 3BH 00H 21H 05H 20H DFH 11H 05H 20H E1H C3H
0F10H=DAH 0EH E5H CDH 36H 0FH E1H 11H 27H 20H DFH C9H 11H 3BH 00H 21H
0F20H=1DH 20H DFH 3EH 01H 32H 1DH 20H 3EH 10H 32H 1EH 20H 11H 1DH 20H
0F30H=21H 4BH 20H C3H B6H 0EH 21H 22H 20H DFH 3AH 22H 20H 57H E6H 7FH
0F40H=32H 22H 20H 7AH E6H 80H 32H 2CH 20H 11H 3BH 00H 21H 27H 20H DFH
0F50H=AFH F5H 21H 21H 20H E5H 3EH 09H 32H D9H 20H 3AH D9H 20H 3DH CAH
0F60H=9FH 0FH 32H D9H 20H E1H F1H A7H 7EH CAH 80H 0FH E6H F0H CAH 7CH
0F70H=0FH 07H 07H 07H 07H 47H E5H CDH 35H 10H E1H AFH 2BH C3H 8DH 0FH
0F80H=E6H 0FH CAH 8BH 0FH 47H E5H CDH 35H 10H E1H 3EH 01H F5H E5H 21H
0F90H=22H 20H 7EH E6H 80H 47H 7EH 3CH E6H 7FH B0H 77H C3H 5BH 0FH 3AH
0FA0H=1DH 20H E6H 7FH 47H 3EH 08H 90H E6H 7FH 47H 21H 27H 20H 7EH 90H
0FB0H=E6H 7FH 47H 3AH 1DH 20H E6H 80H 4FH 3AH 2CH 20H A9H B0H 77H E1H
0FC0H=F1H C9H AFH 32H DDH 20H E5H 21H 27H 20H 7EH E6H 80H 4FH 3AH 3BH
0FD0H=20H 81H 77H 21H 26H 20H 11H 2BH 20H 0EH 04H AFH 1AH 8EH 27H 12H
0FE0H=2BH 1BH 0DH C2H DCH 0FH D2H 12H 10H C5H 21H 2BH 20H 06H 01H CDH
0FF0H=66H 10H 21H 28H 20H 7EH C6H 10H 77H 2BH 7EH E6H 80H 4FH 7EH 3CH
1000H=E6H 7FH 81H 77H 21H 26H 20H 06H 01H CDH 66H 10H 3EH 01H 32H DDH
1010H=20H C1H 05H C2H D3H 0FH 3AH DDH 20H B7H CAH 2EH 10H 21H 22H 20H
1020H=D7H 21H 22H 20H 7EH 3CH E6H 7FH 47H 7EH E6H 80H B0H 77H E1H 11H
```

1030H=27H 20H C9H 06H 01H C5H 3AH 22H 20H E6H 7FH 32H 3BH 20H 47H 3AH

1040H=27H 20H E6H 7FH 90H E6H 7FH 47H E6H 40H C2H 5BH 10H 3AH 27H 20H

1050H=E6H 7FH 32H 3BH 20H 21H 26H 20H C3H 8DH 10H 21H 2BH 20H AFH 90H

1060H=E6H 7FH 47H C3H 8DH 10H AFH B8H C8H E5H 05H 16H 03H 7EH E6H F0H

1070H=4FH 2BH 7EH E6H 0FH B1H 07H 07H 07H 07H 23H 77H 2BH 15H C2H 6DH

1080H=10H 7EH E6H F0H 07H 07H 07H 07H 77H E1H C3H 66H 10H CDH 66H 10H

1090H=C1H 3AH 22H 20H E6H 80H 4FH 3AH 27H 20H E6H 80H 81H CAH C2H 0FH

10A0H=21H 22H 20H 11H 27H 20H 79H B7H C2H FAH 0EH EBH C3H FAH 0EH 21H

10B0H=D3H 20H 11H 34H 20H 0EH 03H CDH 36H 11H 12H 13H 0DH C2H B7H 10H

10C0H=EBH 11H 08H 20H 0EH 03H CDH 1AH 00H 11H 36H 20H 21H 39H 20H 1AH

10D0H=86H 27H 32H E2H 20H 2BH 1BH 1AH 8EH 27H 32H E1H 20H 2BH 1BH 1AH

10E0H=8EH 27H 32H E0H 20H 21H E2H 20H 3AH 8AH 20H B7H C2H F0H 10H 77H

10F0H=CDH 27H 11H 2BH CDH 27H 11H 2BH 3EH 23H BEH D2H 0AH 11H 7EH D6H

1100H=24H 77H 3AH DFH 20H 3CH 27H 32H DFH 20H 21H E2H 20H 0EH 03H 11H

1110H=E5H 20H 7EH 47H E6H 0FH 12H 1BH 2BH 78H E6H F0H 07H 07H 07H 07H

1120H=12H 1BH 0DH C2H 12H 11H C9H 3EH 59H BEH D0H 7EH D6H 60H 77H 2BH

1130H=34H 7EH 27H 77H 23H C9H 7EH 07H 07H 07H 07H 23H 46H B0H 23H C9H

1140H=CDH A2H 05H 32H 3AH 20H 1EH 0FH CDH CBH 0CH CDH FEH 12H CAH D4H

1150H=00H 21H F7H 20H FEH 02H C2H 60H 11H 7EH F6H 01H 77H C3H 46H 11H

1160H=FEH 03H C2H 6CH 11H 7EH F6H 02H 77H C3H 46H 11H FEH 0DH CAH 93H

1170H=11H FEH 01H C2H 89H 11H 3AH 3AH 20H C6H 09H 32H 3AH 20H 1EH 04H

1180H=CDH CBH 0CH CDH FEH 12H C3H D4H 00H 3AH 3AH 20H 3DH CAH 05H 17H

1190H=C3H 29H 17H CDH 99H 11H C3H D4H 00H CDH A8H 11H D2H A2H 11H C3H

11A0H=E0H 0BH CDH 26H 0DH C3H CBH 11H 3AH 3AH 20H 3DH CAH BCH 11H CDH

11B0H=9EH 19H CDH 33H 05H D8H CDH F4H 0BH C3H C6H 11H CDH 40H 19H CDH

11C0H=33H 05H D8H CDH EDH 0BH 11H 13H 20H B7H C9H 21H 0BH 20H 0EH 12H

11D0H=7EH B7H C2H DBH 11H 0DH 23H C2H D0H 11H C9H 3EH 20H 32H 00H 30H

11E0H=21H 1CH 20H 3EH 80H 32H FBH 20H CDH 45H 12H CDH DCH 05H AFH D3H

11F0H=07H C3H F7H 11H CDH 45H 12H 7EH F6H 80H D3H 06H CDH C8H 05H AFH

1200H=D3H 06H CDH DCH 05H 0DH 2BH C2H F4H 11H 3EH 20H 32H 00H 30H CDH

1210H=45H 12H 0EH 1EH 0DH CAH 24H 12H CDH 6EH 12H C2H 14H 12H CDH 45H

1220H=12H CDH 45H 12H 3AH FBH 20H 4FH AFH 32H FBH 20H 32H 00H 30H 79H

1230H=0FH D2H 39H 12H F5H CDH 8DH 03H F1H 0FH D2H 40H 12H C3H D4H 00H

1240H=0FH D0H C3H A1H 0BH F5H E5H 3AH E6H 20H 3CH FEH 04H C2H 51H 12H

1250H=AFH 32H E6H 20H 21H 9BH 12H B7H CAH 60H 12H 23H 3DH C3H 57H 12H

1260H=7EH D3H 07H D3H 07H CDH DCH 05H AFH D3H 07H E1H F1H C9H 3AH E6H

1270H=20H FEH 04H D2H 7AH 12H 3DH F2H 7CH 12H 3EH 03H 32H E6H 20H 21H

1280H=9BH 12H B7H CAH 8BH 12H 23H 3DH C3H 82H 12H 7EH D3H 07H D3H 07H

1290H=CDH DCH 05H AFH D3H 07H DBH 02H E6H 40H C9H 09H 0AH 06H 05H 1EH

12A0H=0AH CFH CAH ECH 12H FEH 08H CAH E6H 12H F5H CDH A2H 05H C1H CDH

12B0H=66H 1AH FEH 01H CAH D6H 12H FEH 07H CAH 83H 1AH 1EH 0CH CFH CAH

12C0H=83H 1AH FEH 02H CAH CCH 12H 3EH 08H C3H CEH 12H 3EH 04H 2AH EBH

12D0H=20H B6H 77H C3H BCH 12H 1EH 0BH CFH CAH 83H 1AH 2AH EBH 20H 7EH

12E0H=F6H 04H 77H C3H D6H 12H CDH 69H 14H C3H D4H 00H C6H 20H 32H FCH

12F0H=20H C3H D4H 00H 3EH F0H C3H FFH 12H 3EH FFH C3H FFH 12H AFH 32H

1300H=DDH 20H CDH A1H 13H AFH 32H DAH 20H AFH 32H 0AH 20H 32H 39H 20H

1310H=E5H CDH 77H 0CH E1H C0H F5H E5H 1EH 03H CDH CBH 0CH E1H F1H FEH

1320H=0AH CAH 7BH 13H FEH 0BH C2H 34H 13H 3AH DDH 20H FEH F0H C2H 97H

1330H=13H C3H D4H 00H FEH 0CH C2H 46H 13H 3AH DDH 20H B7H CAH 9CH 13H

1340H=FEH F0H CAH D4H 00H C9H 57H 3AH DAH 20H A7H CAH 10H 13H 7AH FEH

1350H=0DH C2H B8H 13H 3AH 0AH 20H A7H CAH 10H 13H 11H 34H 20H C3H 18H

1360H=00H 3AH 3AH 20H 47H AFH 21H 70H 13H 05H C8H 86H 23H C3H 69H 13H

1370H=0FH 0FH 0AH 0AH 05H 05H 0AH 0AH 0FH 0FH 0FH 1EH 00H CDH 61H 13H

1380H=21H 50H 20H 83H 06H 00H 4FH 09H E5H E5H D1H CDH A4H 18H E1H 3EH

1390H=01H 32H DAH 20H C3H 09H 13H 1EH 05H C3H 7DH 13H 1EH 0AH C3H 7DH

13A0H=13H E5H C5H 21H 2CH 20H 11H 3BH 00H 0EH 08H CDH 1AH 00H 11H 3BH

13B0H=00H 21H 34H 20H DFH C1H E1H C9H FEH 0FH C2H 09H 14H 3AH 39H 20H

13C0H=B7H CAH E8H 13H E5H 21H 33H 20H 1EH 07H 7EH E6H 3FH CAH D9H 13H

13D0H=2BH 1DH C2H CAH 13H E1H C3H 10H 13H 7EH EEH 40H 77H 21H 34H 20H

13E0H=7EH EEH 80H 77H E1H C3H 10H 13H 3EH 01H 32H 39H 20H 3AH 0AH 20H

13F0H=B7H C2H FEH 13H CDH A1H 13H 3CH 32H 0AH 20H 32H 34H 20H 3AH 33H

1400H=20H F6H 80H 32H 33H 20H C3H 10H 13H E5H 5FH 3AH 39H 20H B7H 3AH

1410H=0AH 20H C2H 1BH 14H B7H D5H CCH A1H 13H D1H 3CH 4FH 3AH 2DH 20H

1420H=B7H C2H 65H 14H 79H 32H 0AH 20H 21H 35H 20H 3DH CAH 37H 14H 3DH

1430H=CAH 40H 14H 23H C3H 2BH 14H 7BH 07H 07H 07H 07H 77H C3H 43H 14H

1440H=7EH 83H 77H D5H 21H 2DH 20H 11H 2EH 20H 0EH 06H CDH 1AH 00H D1H

1450H=21H B9H 04H 16H 00H 19H 7EH 32H 33H 20H 3AH 39H 20H A7H C2H 65H

1460H=14H 21H 34H 20H 34H E1H C3H 10H 13H CDH A1H 13H CDH D1H 15H CDH

1470H=37H 1CH 21H EDH 20H 0EH 00H 46H 23H 05H FAH EEH 15H CDH 6BH 0DH

1480H=0CH C5H E5H 21H 0BH 20H 3EH 30H 81H 77H 23H 36H 2EH 23H 36H 20H

1490H=23H 11H 36H 15H E3H 7EH E3H E6H 03H CAH A6H 14H 11H 3BH 15H 3DH

14A0H=CAH A6H 14H 11H 45H 15H 0EH 05H CDH 1AH 00H 36H 20H 23H 06H 32H

14B0H=E3H 7EH 07H DAH B7H 14H 05H E3H 70H 23H 36H 20H 23H E3H 7EH E3H

14C0H=E6H 03H FEH 03H CAH FEH 14H FEH 01H CAH 26H 15H E3H 7EH E6H 0CH

14D0H=0FH 0FH 11H 4AH 15H B7H CAH F8H 14H 11H 51H 15H 3DH C2H EEH 14H

14E0H=3AH D1H 20H E6H 0FH C2H F8H 14H 11H A0H 15H C3H F8H 14H 11H 58H

14F0H=15H 3DH CAH F8H 14H 11H 5FH 15H 0EH 07H E3H CDH 1AH 00H CDH CBH

1500H=11H E1H C1H 7EH E6H 70H CAH 78H 14H E5H 21H 34H 20H 07H 16H 03H

1510H=07H DAH 1CH 15H 15H CAH 22H 15H 23H C3H 10H 15H 71H 23H 15H C2H

1520H=10H 15H E1H C3H 78H 14H E3H 11H 66H 15H 7EH E6H 04H CAH F8H 14H

1530H=11H 6DH 15H C3H F8H 14H 50H 52H 45H 53H 2EH 54H 45H 4DH 50H 2EH

1540H=53H 4CH 4FH 50H 45H 42H 41H 54H 54H 2EH 50H 2EH 53H 2EH 49H 2EH

1550H=20H 4BH 47H 2FH 53H 51H 43H 4DH 49H 4EH 2EH 20H 48H 32H 4FH 43H

1560H=4DH 2EH 20H 48H 32H 4FH 44H 45H 47H 2EH 20H 46H 20H 44H 45H 47H

1570H=2EH 20H 43H 20H 44H 49H 53H 50H 4CH 41H 59H 20H 20H 3DH 20H 54H

1580H=41H 53H 4BH 20H 23H 41H 4EH 41H 4CH 4FH 47H 20H 23H 20H 3DH 20H

1590H=54H 41H 53H 4BH 20H 23H 49H 4EH 54H 45H 52H 56H 41H 4CH 20H 3DH

15A0H=2AH 20H 2AH 20H 2AH 20H 2AH 1EH 0DH CFH 4FH 21H EDH 20H 7EH B9H

15B0H=DAH D4H 00H 06H 09H 16H BFH 7AH A6H 77H 23H 05H C2H B7H 15H 21H

15C0H=EEH 20H 0DH CAH CAH 15H 23H C3H C2H 15H 3EH 40H B6H 77H C3H D4H

15D0H=00H 0EH 12H 21H 0BH 20H 36H 2AH 23H 0DH C2H D6H 15H C3H CBH 11H

15E0H=21H EDH 20H 46H 23H 05H F8H 7EH A2H B9H C8H C3H E4H 15H CDH 0AH

15F0H=12H 0EH 00H 16H 83H CDH E0H 15H FAH 0AH 16H 11H 50H 20H 21H 8AH

1600H=09H CDH 63H 09H 11H AFH 20H CDH 63H 09H 0EH 80H 16H 83H CDH E0H

1610H=15H FAH 23H 16H 11H 5FH 20H 21H 00H 0AH CDH 63H 09H 11H BEH 20H

1620H=CDH 63H 09H 0EH 01H 16H 83H CDH E0H 15H FAH 38H 16H 11H 8CH 20H

1630H=21H 36H 0AH 0EH 02H CDH 65H 09H 0EH 81H 16H 83H CDH E0H 15H FAH

1640H=4DH 16H 11H 96H 20H 21H 48H 0AH 0EH 02H CDH 65H 09H 0EH 20H 51H

1650H=CDH E0H 15H FAH 61H 16H 11H 6EH 20H 21H 5AH 0AH 0EH 02H CDH 65H

1660H=09H 0EH 10H 51H CDH E0H 15H FAH 75H 16H 11H 78H 20H 21H 6CH 0AH

1670H=0EH 02H CDH 65H 09H 0EH 04H 16H 0FH CDH E0H 15H FAH 92H 16H 3AH

1680H=D1H 20H E6H 0FH C2H 92H 16H 11H CDH 20H 21H 7EH 0AH 0EH 01H CDH

1690H=65H 09H 3AH 34H 20H B7H CAH A3H 16H 11H 74H 15H CDH FAH 16H 70H

16A0H=CDH CBH 11H 3AH 35H 20H B7H CAH B9H 16H 11H 85H 15H CDH FAH 16H

16B0H=3EH 31H 32H 13H 20H 70H CDH CBH 11H 3AH 36H 20H B7H CAH CFH 16H

16C0H=11H 85H 15H CDH FAH 16H 3EH 32H 32H 13H 20H 70H CDH CBH 11H 11H

16D0H=87H 20H CDH 26H 0DH 21H 25H 20H 11H 16H 20H 0EH 06H CDH 1AH 00H

16E0H=11H 96H 15H 21H 0BH 20H 0EH 0AH CDH 1AH 00H EBH 21H 25H 20H 06H

16F0H=00H CDH 63H 1CH CDH D1H 15H C3H 0AH 12H 21H 0BH 20H 0EH 11H C6H

1700H=30H 47H C3H 1AH 00H CDH 40H 19H 21H 08H 17H E5H CDH 33H 05H DAH

1710H=CBH 0BH CDH 40H 19H 3AH 51H 20H B7H C2H 22H 17H 11H 00H 20H C3H

1720H=A4H 18H CDH EDH 0BH CDH A9H 18H C9H CDH 9EH 19H 21H 2CH 17H E5H

1730H=CDH 33H 05H DAH CBH 0BH CDH 9EH 19H 3AH 60H 20H B7H C2H 46H 17H

1740H=11H 00H 20H C3H A4H 18H CDH F4H 0BH CDH A9H 18H C9H 3AH EDH 20H

```
1750H=B7H CAH D4H 00H 3EH 0EH D3H 0CH EFH CDH 69H 14H 3AH D2H 20H 32H
1760H=DFH 20H CDH EDH 19H CDH AFH 10H C3H 6EH 17H CDH F3H 19H CDH AEH
1770H=0AH C5H CDH A8H 01H C1H 78H 2FH 47H 3AH F8H 20H B0H C2H 8BH 17H
1780H=21H 89H 20H 7EH E6H FEH 2BH B6H C2H 9AH 17H CDH 8EH 18H DAH 6EH
1790H=17H 21H E0H 20H CDH B2H 10H C3H 6BH 17H 21H 24H 20H 22H 08H 20H
17A0H=3EH 02H D3H 0CH EFH CDH 43H 04H DBH 0DH E6H 1FH 06H 00H 21H 25H
17B0H=20H 22H 08H 20H CDH 87H 04H 21H DFH 20H 11H D2H 20H 1AH 96H 4FH
17C0H=CAH C5H 17H 0EH 24H 23H CDH 36H 11H 81H 27H 4FH EBH 21H 22H 20H
17D0H=CDH 36H 11H 47H CDH 47H 18H CAH F7H 17H 4FH F3H 3EH 06H D3H 0CH
17E0H=DBH 0FH E6H 1CH 47H DBH 0FH E6H 1CH B8H CAH E4H 17H 0DH CAH FBH
17F0H=17H CDH EEH 1BH C3H E0H 17H CDH 36H 11H 4FH EBH CDH 36H 11H 41H
1800H=4FH CDH 47H 18H CAH 28H 18H 4FH B7H CAH 28H 18H F3H 3EH 0AH D3H
1810H=0CH DBH 0DH E6H 1FH 47H DBH 0DH E6H 1FH B8H CAH 15H 18H 0DH CAH
1820H=28H 18H CDH EEH 1BH C3H 11H 18H F3H 3EH 02H D3H 0CH EFH AFH D3H
1830H=0CH 3EH 53H 32H DEH 20H AFH 32H FEH 20H CDH 4FH 01H 2FH 3CH 32H
1840H=FEH 20H 3EH 01H D3H 03H 76H 37H 3EH 99H CEH 00H 90H 81H 27H C9H
1850H=20H 20H 4DH 45H 4DH 4FH 52H 59H 20H 43H 48H 41H 4EH 47H 45H 44H
1860H=20H 20H 3AH FEH 20H B7H CAH 70H 18H 11H 50H 18H 21H 0BH 20H F7H
1870H=CDH C5H 03H 0EH 05H CDH 93H 18H DAH D4H 00H FBH CDH 8EH 18H DAH
1880H=7CH 18H CDH F3H 19H 21H E0H 20H CDH B2H 10H C3H 9AH 17H CDH C5H
1890H=03H 0EH 07H 21H DFH 20H 11H D2H 20H 1AH BEH D8H C0H 23H 13H 0DH
18A0H=C2H 99H 18H C9H 3EH 01H 32H DCH 20H CDH 7CH 0DH 11H 0BH 20H 0EH
18B0H=04H 7EH E6H F0H 07H 07H 07H 07H 12H 13H 7EH E6H 0FH 12H 13H 23H
18C0H=0DH C2H B1H 18H 21H 2DH 20H 3AH 05H 20H E6H 80H C2H DAH 18H 77H
18D0H=3AH 05H 20H B7H CAH DCH 18H C3H E0H 18H 36H 40H AFH 32H DCH 20H
18E0H=06H 07H 3AH DCH 20H B7H C2H EBH 18H 23H 05H EBH 21H 0AH 20H E5H
18F0H=E1H 23H 7EH E5H 4FH C5H 06H 00H 21H B9H 04H 09H C1H 7EH 12H 13H
1900H=05H C2H F0H 18H E1H 3AH 05H 20H D6H 10H CAH 30H 19H 21H 2CH 20H
1910H=3AH DCH 20H B7H C2H 18H 19H 23H 3AH 05H 20H E6H 7FH B7H CAH 26H
1920H=19H 23H 3DH C3H 1DH 19H 3EH 80H B6H 77H AFH 32H DCH 20H FBH C9H
1930H=32H 33H 20H 21H 2EH 20H 3EH 80H B6H 77H 21H 30H 20H C3H 26H 19H
1940H=06H 00H C5H 3AH F7H 20H 32H 39H 20H AFH 32H F7H 20H 3AH 3AH 20H
1950H=32H 0AH 20H 3EH 07H 80H 32H 3AH 20H CDH 3DH 1BH 21H 00H 24H DFH
1960H=3AH 0AH 20H 32H 3AH 20H 3AH 39H 20H 32H F7H 20H C1H DBH 0FH B7H
1970H=F2H 86H 19H CDH 86H 19H 11H 00H 80H DBH 0FH B7H F2H 86H 19H 1BH
1980H=7AH B3H C2H 79H 19H C9H AFH D3H 05H 3EH 30H D3H 05H AFH D3H 05H
1990H=78H D3H 04H C5H CDH C3H 05H C1H 78H C6H 08H D3H 04H C9H 06H 01H
19A0H=C3H 42H 19H CDH A1H 13H 1EH 10H CFH CAH B2H 19H CDH EDH 19H C3H
```

```
19B0H=D4H 00H FEH 0CH C2H C3H 19H 21H EDH 20H 36H 00H 23H 22H EBH 20H
19C0H=C3H D4H 00H 1EH 0DH CFH 47H 21H EDH 20H 7EH B8H DAH D4H 00H 3EH
19D0H=09H 90H 4FH 2BH 2BH 35H 23H 23H 35H 23H 05H C2H D9H 19H 36H 00H
19E0H=E5H D1H 13H 0DH FAH D4H 00H 1AH 77H 23H C3H E2H 19H CDH 37H 1CH
19F0H=C3H F6H 19H CDH 3AH 1CH 21H EDH 20H 46H 05H FAH 0AH 12H 23H C5H
1A00H=E5H 7EH E6H 03H CAH 2BH 1AH 3DH CAH 46H 1AH 3DH CAH 61H 1AH 7EH
1A10H=07H 3EH 01H CEH 00H 32H 3AH 20H 21H 22H 1AH E5H 3EH FFH F5H C3H
1A20H=3AH 03H CDH 26H 0DH CDH CBH 11H C3H 61H 1AH CDH 34H 1AH CDH 99H
1A30H=11H C3H 61H 1AH 7EH 0FH 0FH E6H 03H 32H F7H 20H 7EH 07H 3EH 01H
1A40H=CEH 00H 32H 3AH 20H C9H 7EH 07H 3EH 07H CEH 00H 32H 3AH 20H 7EH
1A50H=E6H 04H 32H F7H 20H CDH 3DH 1BH CDH 26H 0DH CDH CBH 11H C3H 61H
1A60H=1AH E1H C1H C3H FAH 19H 2AH EBH 20H 36H 00H 3DH 0FH 77H 78H 0EH
1A70H=00H FEH 00H CAH 7EH 1AH 0CH FEH 01H CAH 7EH 1AH 0CH 0CH 79H B6H
1A80H=77H 78H C9H 21H EDH 20H 7EH FEH 09H CAH D4H 00H 34H 21H EBH 20H
1A90H=34H C3H D4H 00H 21H AFH 20H B7H CAH 9EH 1AH 21H BEH 20H 11H 05H
1AA0H=00H E5H 19H E5H 19H E5H 11H 00H 24H 21H 1DH 20H DFH 11H 00H 24H
1AB0H=CDH 36H 0FH D1H 21H 1DH 20H DFH 11H 27H 20H 21H 34H 20H CDH 12H
1AC0H=0FH D1H 21H 1DH 20H DFH 11H 00H 24H CDH 36H 0FH 11H 34H 20H 21H
1AD0H=22H 20H DFH CDH 33H 10H 21H 27H 20H DFH D1H 21H 22H 20H DFH CDH
1AE0H=33H 10H 21H 27H 20H DFH 11H 13H 20H 21H 22H 20H DFH CDH 33H 10H
1AF0H=21H 13H 20H DFH 11H 13H 20H C9H CDH A2H 05H C6H 06H 32H 3AH 20H
1B00H=1EH 06H CDH CBH 0CH CDH F9H 12H CAH D4H 00H FEH FFH CAH D4H 00H
1B10H=FEH 0DH CAH 27H 1BH FEH 0EH CAH 33H 1BH 3EH FFH 32H F7H 20H 1EH
1B20H=07H CFH FEH 0DH C2H 33H 1BH CDH 3DH 1BH CDH 26H 0DH CDH CBH 11H
1B30H=C3H D4H 00H CDH 3DH 1BH CDH A9H 18H EFH C3H 33H 1BH 3AH 3AH 20H
1B40H=FEH 07H F5H CDH D2H 04H CDH C8H 02H F1H 11H 91H 20H CAH 53H 1BH
1B50H=11H 9BH 20H D5H CDH 36H 0FH D1H 7BH D6H 05H 5FH 21H 22H 20H DFH
1B60H=CDH 33H 10H 3AH F7H 20H B7H C8H 21H 7CH 1BH CDH B6H 0EH 21H 1DH
1B70H=20H DFH 11H 81H 1BH CDH 36H 0FH 11H 27H 20H C9H 02H 32H 00H 00H
1B80H=00H 00H 55H 55H 55H 55H 3EH 05H 32H 3AH 20H 1EH 09H CDH CBH 0CH
1B90H=CDH F4H 12H C2H 17H 1CH 3EH 10H 32H 82H 20H 3EH 4EH 32H DEH 20H
1BA0H=CDH A1H 13H 3EH 76H 32H 30H 20H 3EH 0DH D3H 0CH EFH AFH D3H 0CH
1BB0H=3AH 83H 20H 4FH B7H CAH BFH 1BH 3EH 04H D3H 0CH CDH F9H 1BH 3AH
1BC0H=84H 20H 4FH B7H CAH DFH 1BH 3AH 83H 20H B7H C2H D2H 1BH 3EH 08H
1BD0H=D3H 0CH CDH C3H 04H 0DH CAH DFH 1BH CDH EEH 1BH C3H D2H 1BH AFH
1BE0H=D3H 0CH EFH 3EH 05H D3H 0CH EFH AFH D3H 0CH C3H 1CH 1CH 79H E6H
1BF0H=0FH FEH 0AH D8H 79H D6H 06H 4FH C9H DBH 0FH E6H 1CH 47H DBH 0FH
1C00H=E6H 1CH B8H CAH FDH 1BH 0DH C8H 79H E6H 0FH FEH 0AH DAH F9H 1BH
```

```
1C10H=79H D6H 06H 4FH C3H F9H 1BH FEH 0EH C2H 31H 1CH CDH C5H 03H 21H
1C20H=2EH 20H 11H 00H 20H 0EH 06H CDH 1AH 00H AFH 32H 2DH 20H C3H 1CH
1C30H=1CH CDH 37H 1CH C3H D4H 00H CDH C5H 03H CDH 6BH 0DH 21H 22H 20H
1C40H=11H 11H 20H 06H 30H 3AH D2H 20H FEH 10H DAH 57H 1CH 4FH E6H F0H
1C50H=07H 07H 07H 07H 80H 12H 79H 13H E6H 0FH 80H 12H 3EH 20H 13H 12H
1C60H=13H 12H 13H 7EH 80H 12H 13H 23H 7EH 80H 12H 13H 23H 3EH 3AH 12H
1C70H=13H 7EH 80H 12H 13H 23H 7EH 80H 12H 13H 3EH 3AH 12H 13H 23H 7EH
1C80H=80H 12H 13H 23H 7EH 80H 12H C3H CBH 11H 3EH 06H 32H 3AH 20H 1EH
1C90H=05H CDH CBH 0CH CDH F4H 12H 3EH 10H 32H 87H 20H C3H D4H 00H
```

I claim:

1. A system for measuring pressure in an oil well, comprising:

pressure transducer means for generating an electrical signal having a frequency which is a known function of the pressure received by said pressure transducer, said transducer being specially adapted for placement in said oil well;

processing means receiving said counter output signal for periodically calculating the pressure corresponding to said frequency according to said known function, and providing an output signal indicative of said pressure, said processing means repetitively performing said pressure calculation over a relatively long period of time with each pressure calculation requiring a relatively short period of time;

output means receiving the output of said processing means and providing an indication of said pressure for each measurement; and quiescent power means for removing power to portions of said system between said calculations.

2. The oil well instrumentation system of claim 1 wherein said quiescent power means comprise:

power control means for selectively removing power from said processing means and a first set of electrical components responsive to a power-down control signal while a second set of electrical components are continuously powered, and for applying power to said first set of electrical components responsive to a power-up control signal; and timer means initialized by said power-down control signal for generating said power-up control signal a preset period after said power-down control signal is produced.

3. The oil well instrumentation system of claim 2 wherein the power-down period of said timer means is programmed by said processing means prior to said processing means generating said power-down control signal.

4. The oil well instrumentation system of claim 2 wherein said processing means includes a random access memory enabled responsive to a memory enable signal, and wherein said power control means further includes means for preventing said enable signal from being produced for a predetermined period after said power-up control signal is generated so that data is not read into said random access memory as power is applied to said processing means responsive to said power-up control signal.

5. The oil well instrumentation system of claim 2 wherein said timer means is a conventional metal-oxide-silicon alarm clock integrated circuit.

6. The oil well instrumentation system of claim 2 wherein said first set of electrical components comprise a central processing unit, a read only memory, said interval counter means, said output means and said pressure transducer means.

7. The oil well instrumentation system of claim 6 wherein said second set of electrical components consists of a set of random access memories.

8. The oil well instrumentation system of claim 1 further including temperature transducer means for generating an electrical signal having a voltage which is a known function of the temperature sensed by said temperature transducer means, said transducer means being specially adapted for placement in said oil well, and wherein said processing means further includes means for calculating the temperature corresponding to said voltage according to a known function and providing an output signal indicative thereof.

9. The oil well instrumentation system of claim 1 wherein said system is powered by a pair of rechargeable batteries, and said system further includes voltage sensing means for measuring the condition of said batteries and display means for indicating whether said batteries are discharged, fully charged or charging.

* * * * *